US005765342A

United States Patent [19]

Jensen et al.

[11] Patent Number: 5,765,342

[45] Date of Patent: Jun. 16, 1998

[54] PILL OR CAPSULE CARD FILLING APPARATUS AND METHOD

[76] Inventors: Richard B. Jensen; Jason R. Jensen, both of 121 Point West Blvd., St. Charles, Mo. 63301

[21] Appl. No.: 337,631

[22] Filed: Nov. 9, 1994

Related U.S. Application Data

[63] Continuation-in-part of Ser. No. 136,468, Oct. 13, 1993, Pat. No. 5,450,710.

[51] Int. Cl.[6] ..... B65B 5/08; B65B 61/26; B65B 7/28

[52] U.S. Cl. ..... 53/411; 53/471; 53/475; 53/131.4; 53/250; 53/282

[58] Field of Search ..... 53/467, 475, 473, 53/158, 246, 249, 250, 253, 427, 453, 411, 131.4, 131.5, 377.8, 378.3, 471, 282

[56] References Cited

U.S. PATENT DOCUMENTS

| | | | |
|---|---|---|---|
| 244,308 | 7/1881 | Reymond . | |
| D. 263,559 | 3/1982 | Poore | D9/3 |
| D. 281,176 | 10/1985 | Sukovich | D20/18 |
| D. 306,825 | 3/1990 | Siegel | D9/345 |
| D. 312,394 | 11/1990 | Hassey | D9/341 |
| D. 322,400 | 12/1991 | Sorensen | D9/415 |
| D. 322,934 | 1/1992 | Kalvelage | D9/341 |
| D. 323,109 | 1/1992 | Kalvelage | D9/341 |
| 693,637 | 2/1902 | Brethour . | |
| 938,356 | 7/1909 | Brown . | |
| 964,782 | 7/1910 | Hull . | |
| 1,409,009 | 3/1922 | Julien . | |
| 1,488,603 | 4/1924 | Kouwenhoven . | |
| 1,553,115 | 9/1925 | Shaw . | |
| 1,562,063 | 11/1925 | Schuler . | |
| 1,597,246 | 8/1926 | Query . | |
| 1,632,852 | 6/1927 | Richter . | |
| 1,803,656 | 5/1931 | Schuler . | |
| 2,143,518 | 1/1939 | Kolin | 214/1 |
| 2,173,982 | 9/1939 | Schettler | 269/309 X |
| 2,339,115 | 1/1944 | Scherer | 226/2 |
| 2,615,363 | 10/1952 | Martyn | 86/46 |
| 2,637,152 | 5/1953 | Kraus | 53/5 |
| 2,673,805 | 3/1954 | Colman | 99/171 |
| 2,696,334 | 12/1954 | Rhodes | 53/250 X |
| 2,758,756 | 8/1956 | Tea, Jr. | 222/270 |
| 2,801,025 | 7/1957 | Cookson et al. | 221/203 |
| 2,921,785 | 1/1960 | Underhill | 269/309 X |
| 2,928,364 | 3/1960 | Davis | 269/309 X |
| 3,049,224 | 8/1962 | Fredette et al. | 206/42 |
| 3,054,679 | 9/1962 | Bradford | 99/171 |
| 3,086,639 | 4/1963 | Donofrio | 198/33 |
| 3,092,945 | 6/1963 | Wizelman | 53/373 |
| 3,139,712 | 7/1964 | De Woskin | 53/453 X |
| 3,143,208 | 8/1964 | Sizemore, Jr. | 206/56 |

(List continued on next page.)

FOREIGN PATENT DOCUMENTS 577151 5/1946 United Kingdom .

OTHER PUBLICATIONS

Operations Manual for Aylward Feed Systems and Aylward Frame Assemblies—Model GMP (1992).

Aylward Enterprises: Leading the Pharmaceutical Industry in Blister Pack Feed Systems (1992).

Packaging Week, 11th Nov., 1992.

Packaging Digest, Oct., 1993.

Packaging Digest, Mar., 1994.

Uhlmann UP/1 (pictured machine believed to have been manufactured in 1961).

Ivers Lee UNA-STRIP Packer Model SA (1955–1965 aprox.).

*Primary Examiner*—Horace M. Culver

*Attorney, Agent, or Firm*—Suelthaus & Walsh; John W. Kepler, III

[57] ABSTRACT

An automatic apparatus is provided for automatically performing the steps of filling a pill card or capsule with a desired pill or capsule, folding the pill card, heat sealing the pill card, and, if desired, printing a label directly onto the pill card.

56 Claims, 37 Drawing Sheets

U.S. PATENT DOCUMENTS

| | | | |
|---|---|---|---|
| 3,181,739 | 5/1965 | Dye | 222/158 |
| 3,195,284 | 7/1965 | Crane, Jr. | 53/453 |
| 3,199,263 | 8/1965 | Lee | 53/250 X |
| 3,250,385 | 5/1966 | Timms | 206/56 |
| 3,281,012 | 10/1966 | Martell | 221/172 |
| 3,314,575 | 4/1967 | Graham | 222/330 |
| 3,370,365 | 2/1968 | Vosbikian | 40/10 |
| 3,503,493 | 3/1970 | Nagy | 206/56 |
| 3,512,332 | 5/1970 | Klein | 53/453 X |
| 3,545,164 | 12/1970 | Middleton | 53/26 |
| 3,551,673 | 12/1970 | Siegel | 250/69 |
| 3,566,929 | 3/1971 | Mead | 141/237 |
| 3,628,694 | 12/1971 | Nichols | 53/246 X |
| 3,630,346 | 12/1971 | Burnside | 206/56 AB |
| 3,660,962 | 5/1972 | Bliss et al. | 53/453 X |
| 3,692,228 | 9/1972 | Spiegel | 229/29 |
| 3,702,103 | 11/1972 | Price et al. | 113/114 |
| 3,715,856 | 2/1973 | Borel | 53/41 |
| 3,728,842 | 4/1973 | Wyland | 53/378.3 |
| 3,754,374 | 8/1973 | Haines | 53/373 |
| 3,775,941 | 12/1973 | Bross | 53/246 |
| 3,780,856 | 12/1973 | Braverman | 206/56 AB |
| 3,789,575 | 2/1974 | Bross | 53/249 X |
| 3,809,221 | 5/1974 | Compere | 206/461 |
| 3,835,995 | 9/1974 | Haines | 206/42 |
| 3,874,143 | 4/1975 | Braber | 53/453 X |
| 3,913,734 | 10/1975 | Siegel | 206/498 |
| 3,924,748 | 12/1975 | Braverman | 206/534.1 |
| 4,065,000 | 12/1977 | Murton | 214/1 |
| 4,101,284 | 7/1978 | Difiglio et al. | 23/259 |
| 4,122,651 | 10/1978 | Braverman | 53/390 |
| 4,277,024 | 7/1981 | Spector | 239/36 |
| 4,289,258 | 9/1981 | Ransom | 222/308 |
| 4,295,409 | 10/1981 | Simpson | 86/31 |
| 4,411,205 | 10/1983 | Rogers | 111/1 |
| 4,436,268 | 3/1984 | Schreiver | 248/188.2 |
| 4,446,672 | 5/1984 | Raudat | 53/475 X |
| 4,460,106 | 7/1984 | Moulding, Jr. et al. | 221/1 |
| 4,574,954 | 3/1986 | Reid | 206/531 |
| 4,586,316 | 5/1986 | Backman et al. | 53/453 X |
| 4,627,225 | 12/1986 | Faller et al. | 53/510 |
| 4,664,262 | 5/1987 | White | 206/531 |
| 4,685,271 | 8/1987 | Ringer et al. | 53/246 |
| 4,693,057 | 9/1987 | Rittinger et al. | 53/539 |
| 4,694,996 | 9/1987 | Siegel | 241/100 |
| 4,730,849 | 3/1988 | Siegel | 283/70 |
| 4,732,411 | 3/1988 | Siegel | 283/75 |
| 4,750,315 | 6/1988 | Wadell | 53/475 |
| 4,776,150 | 10/1988 | Siegel | 53/329 |
| 4,834,264 | 5/1989 | Siegel et al. | 221/200 |
| 4,958,736 | 9/1990 | Urheim | 206/531 |
| 5,014,851 | 5/1991 | Wick | 206/539 |
| 5,107,775 | 4/1992 | Langlais et al. | 248/157 X |
| 5,129,611 | 7/1992 | Grover et al. | 248/157 X |
| 5,394,670 | 3/1995 | Visser | 53/249 |
| 5,404,693 | 4/1995 | Giovannone | 53/453 |
| 5,419,099 | 5/1995 | Mueller et al. | 53/473 |
| 5,444,961 | 8/1995 | Doane et al. | 53/131.4 X |
| 5,450,710 | 9/1995 | Jensen et al. | 53/475 |

PILL OR CAPSULE CARD FILLING APPARATUS AND METHOD

CROSS REFERENCE TO RELATED APPLICATION

This is a continuation-in-part of application Ser. No. 08/136,468 filed on Sep. 13, 1993, and now U.S. Pat. No. 5,450,710 is incorporated herein by reference.

BACKGROUND OF THE INVENTION

The present invention relates in general to a variable height support apparatus and more specifically to a variable height support apparatus for use in combination with a solid object dispenser such as a pill or capsule dispenser. The variable height support of this invention is an improvement in that it allows a dispenser for filling blister packs with pills or capsules to be easily modified to dispense pills or capsules of various thicknesses without reconfiguration or modification of the dispenser apparatus.

An improvement of the present invention relates to an apparatus for automatically performing the steps of filling a pill card or capsule with a desired pill or capsule. The apparatus of this invention and the method of utilizing the apparatus is also an improvement over the conventional manual filling devices and apparatus. The apparatus and method of the present invention is a further improvement over the apparatus and method disclosed in co-pending U.S. patent application, Ser. No. 136,468, filed Oct. 13, 1993, now U.S. Pat. No. 5,540,710, of which this application is a continuation-in-part.

With the conventional pill or capsule card filling apparatus it is generally necessary to modify or reconfigure the apparatus whenever changing the size, and particularly the thickness of the pills or capsules to be placed in the receptacle portions of the conventional pill or capsule card or blister pack.

Blister packs, consisting of a molded semi-rigid base covered and sealed by a rupturable material, are commonly used for packaging pills and capsules. Blister packs are used both by pharmaceutical companies which manufacture the drugs and package them in blister packs, and by smaller health care facilities which use the blister packs for packaging individual doses. These blister packs are also manufactured by companies in the business of providing unfilled blister packs for filling by third parties.

Many conventional dispensers are manufactured to dispense only one size or shape of pill or capsule. Such dispensers are commonly used by pharmaceutical companies which are geared to produce the filled pill or capsule cards or blister packages in large quantities for a particular pill or capsule.

However, for smaller manufacturers or health care facilities it is desirable to be able to produce and fill the cards or blister packages with pills or capsules of various sizes and shapes and use a minimum number of different dispenser. A single, easily modified dispenser is particularly suited to this portion of the industry.

Conventional dispensers are available which can be modified to dispense pills or capsules of varying shapes and sizes.

However, these conventional dispensers do not include the improvements included in the present invention as described more fully herein and illustrated in the accompanying drawings.

With the conventional pill or capsule card filling apparatus it is generally necessary to manually insert an empty blister card into a paddle and manually feed each paddle with its blister card into a filling apparatus such as that disclosed herein. A drawback associated with the relevant industry is the reliance upon manual operation of the card filling, heat sealing, and related printing of medicine indicia on the pill or capsule card.

SUMMARY OF THE INVENTION

Accordingly, it is an object of the present invention to provide a pill or capsule dispensing support structure in which the height of pill or capsule guiding or transfer member of the structure is easily varied.

Another object of the present invention is to provide a support structure in which the height of the aforementioned structure is varied in 1/32" units.

A further object of the present invention is to provide a variable height support structure which is economically constructed with a minimum of parts to avoid expensive repair or replacement.

Still another object of the present invention is to provide a variable height support structure which is suitable for use in combination with a solid object dispenser.

Still a further object of the present invention is to provide a dispenser capable of filling blister packs with pills or capsules of various thicknesses by simply turning a knob.

Still another object of this invention is to automatically fill, fold, seal, stack and print medicine information on a conventional pill or capsule blister packs.

To accomplish the foregoing and other objects of the pill or capsule card filling apparatus of this invention there is provided a variable height support structure for use in combination with a dispenser. The variable height support structure comprises a work surface supported by an asymmetrical cam, the cam and corresponding axle being supported by a pillow block. The axle protrudes beyond the support structure and includes an end knob to facilitate turning.

When the knob is turned, a different portion of the asymmetric cams are presented to their respective contact portions of the work surface, resulting in movement of the work surface up or down. The cams are preferably designed to move the work surface in increments of 1/32", corresponding to the standard variation in pill or capsule thickness. The cams are held in place at the stated increments by an indexing device comprising a spring-loaded ball bearing mounted within the pillow block and semi-spherical recesses on the cam face.

The work surface is held in level vertical alignment with the dispenser by telescoping support members at the corners of the structure.

When used with a dispenser, the height of the work surface is adjusted to correspond to the thickness of the pill or capsule being dispensed. A conventional paddle containing the blister packs to be filled is inserted into the structure and supported by the work surface in a manual version of the present invention described and claimed in the co-pending U.S. patent application.

The dispenser device includes a bin for holding the bulk pills or capsules to be dispensed and rotating brushes to keep the pills in motion. The pills or capsules are swept by the brushes through apertures or openings in a stationary plate which forms the base of the bin.

A spring-loaded shuttle plate which has openings corresponding to the size or thickness and shape of the pill or capsule is positioned underneath the apertures of openings in the stationary plate such that the pills or capsules fall into the openings. The shuttle plate then moves horizontally until the openings are aligned with apertures in a dispensing plate located beneath the shuttle plate.

The dispensing plate includes apertures which are selected to correspond to the shape of the pill or capsule being dispensed. These apertures in the dispensing plate are aligned with the openings in the blister packs. It will be understood that the number of apertures and their arrangement or pattern in the dispensing plate will vary depending upon the number of receptacles and their arrangement in the receiving blister pack.

The blister packs are held in position by a paddle plate. The pills or capsules drop through the dispensing plate and into the blister packs. The paddle with the now filled blister package is moved by a conveyor to a next station and is replaced with an unfilled blister pack on another paddle which is positioned by the conveyor.

In the improvement of the present invention the filler described in the co-pending U.S. patent application is incorporated in a machine that automatically fills, folds, seals, prints and stacks the blister packs. An operator puts a blister pack on a paddle without a handle, a modified paddle. The blister pack is automatically transported via a conveyor belt or like device to the filler, where the objects fill the blister pack in the manner described above. The blister pack is then transported to the folding and sealing stations. A preferred embodiment uses a heat sealing device. Once the blister pack is folded and sealed, it is flipped off the modified paddle and stacked with other filled blister packs. The modified paddle is transported back to the other end of the machine to start the whole process again.

A printing station may be included for printing medicine related indicia on the now filled and sealed blister package. The indicia may include lot numbers typically used to identify prescribed medicines or any other desired indicia.

These and other objects and features of the present invention will be better understood and appreciated from the following detailed description of preferred embodiments thereof, selected for purposes of illustration and shown in the accompanying drawings.

BRIEF DESCRIPTION OF THE DRAWINGS

FIG. 16, 17 and 18 are plan views of a plurality of dispensing plates used in the dispenser shown in FIG. 1, wherein FIG. 16 illustrates elongated slots or openings for filling a conventional blister package with 30 or 31 pills or capsules, and FIG. 17 and FIG. 18 illustrate apertured plates for dispensing either 90 relatively small or relatively larger pills or capsules;

DETAILED DESCRIPTION

Pill Card Filler Unit

Figure 1:
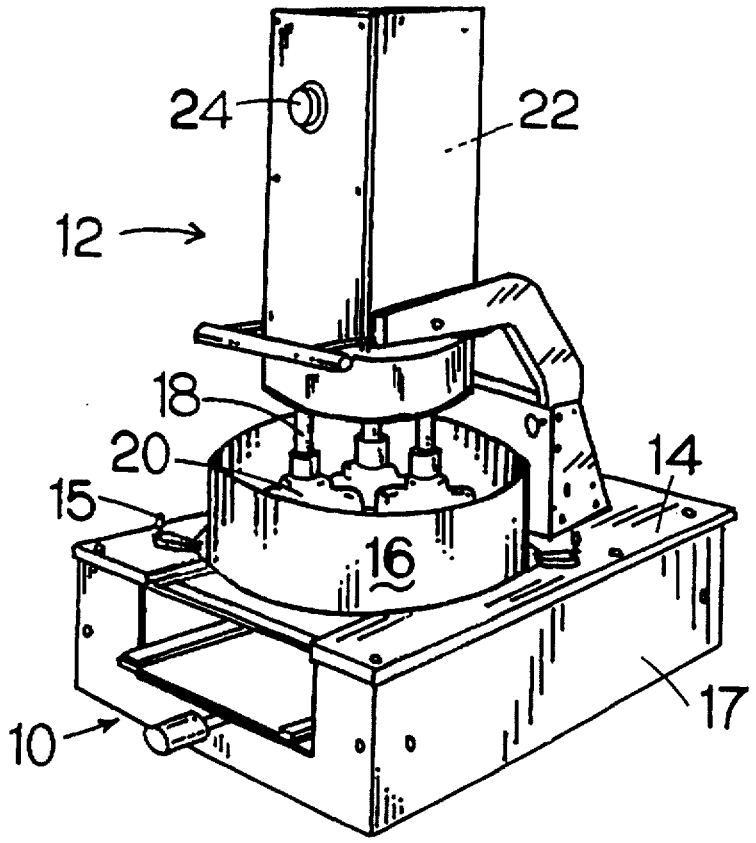
FIG. 1 is a perspective view of the support structure of the present invention in combination with a solid object dispenser.

Referring now to the drawings there is shown a preferred embodiment for the variable height support structure for the dispenser of this invention as disclosed in the co-pending U.S. patent application.

The support structure is described in connection with a solid object dispenser, more particularly a dispenser for dispensing pills or capsules into blister packs. The support structure allows variation of the height of a work surface by use of asymmetric cams supporting the work surface. As the axle bearing the cams is turned, a portion of the cam having a different radius is presented to the work surface. The variation in cam radius results in a variation of the work surface height.

The support structure of the present invention is particularly adapted for use with a pill or capsule dispenser. The location of the adjustable work surface that supports the dispenser plate is determined so as to allow the blister packs to be filled efficiently. It will be understood that the vertical location of the work relative to the shuttle plate surface can be changed as required as the thickness, shape or size of the pill or capsule being dispensed requires.

The support structure of the present invention allows the work surface height to be adjusted in 1/32" increments by turning the axle-mounted knob. This obviates the need to completely disassemble or substantially reconfigure the dispenser to accommodate pills or capsules of varying thicknesses.

The drawings show a preferred embodiment of the variable height support structure generally designated 10 in combination with a solid object dispenser generally designated 12 in FIG. 1.

The presently preferred dispenser 12 has a dispenser base 17 in which the support structure 10 is housed. Base 17 includes a U-shaped cover portion 14 with one or more moveable tabs 15. The cover 14 supports a circular collar 16 which acts as a bin to hold a pill, capsule, pills or capsules to be dispensed. The tabs 15 hold the collar 16 in place.

Mixer rods 18 having brushes 20 rotate to move and mix the pill, capsules, pills or capsules within the collar bin 16 with the rotating brushes. The rods 18 are rotated by a motor 22, and the rotation speed is controlled by the user through a selector 24. It will be understood that a motor driven brush arrangement of this type is conventional.

Figure 10:
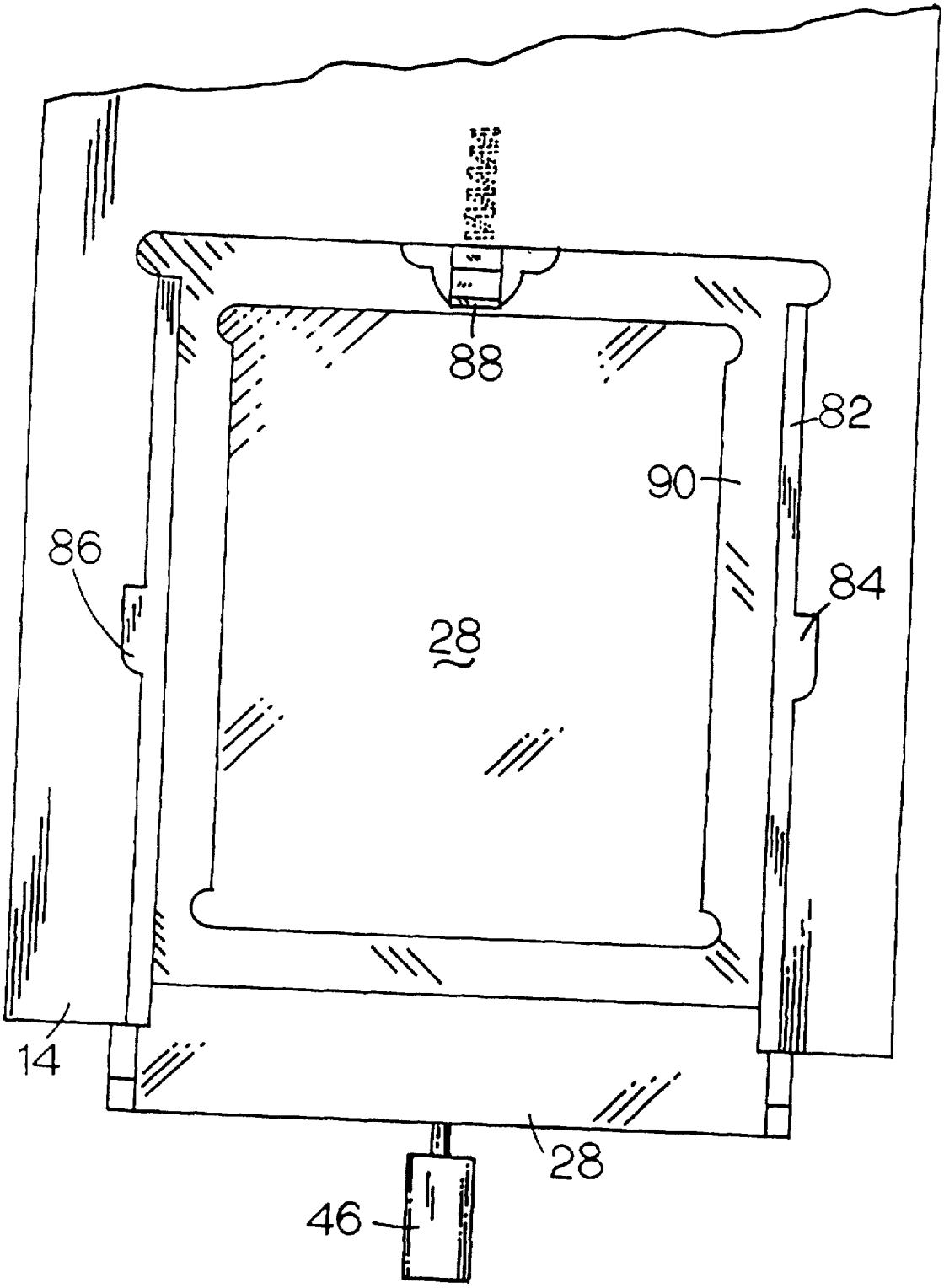
FIG. 10 is a plan view further illustrating the shuttle plate spring device and the dispenser surfaces.

As shown more clearly in FIG. 10, the U-shaped cover 14 has a recessed ledge 82 around its inner perimeter. The ledge 82 further includes two notches 84 and 86 located preferably at the mid-point along each of the "legs" of the U-shaped cover 14. A spring device 88 is mounted on the base portion of the cover 14 and extends horizontally over the recessed ledge 82.

Figure 2:
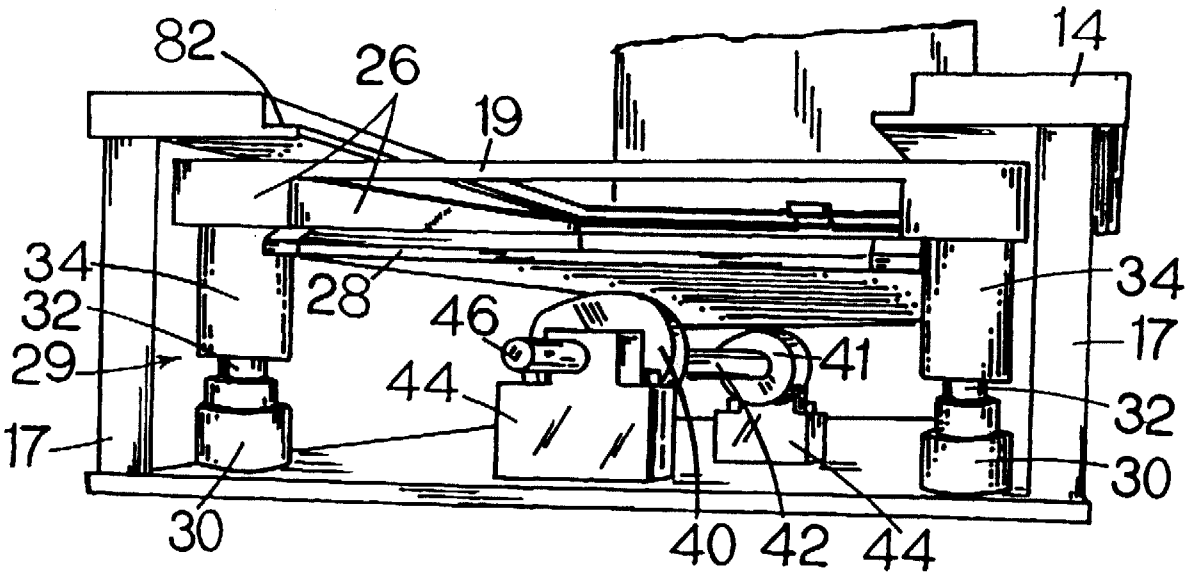
FIG. 2 is a perspective view of the support structure of FIG. 1.

The support structure 10 is shown in more detail in FIG. 2 where the front face of dispenser base 17 has been removed. Structure 10 includes a work surface 28 which is framed by a U-shaped upwardly extending portion 26.

Extending inwardly from the top of the U-shaped extension portion 26 is a second framing portion 90. The work surface 28 is preferably retained in level alignment by telescoping alignment members generally designated 29 located at the four corners of work surface 28.

The alignment members 29 include a guide base 30, an inner telescoping member 32 and an outer telescoping member 34. The alignment members 29 are mounted on a base 36. It will be understood that other alignment arrangements are readily substituted for that shown with the preferred embodiment.

Figure 3:
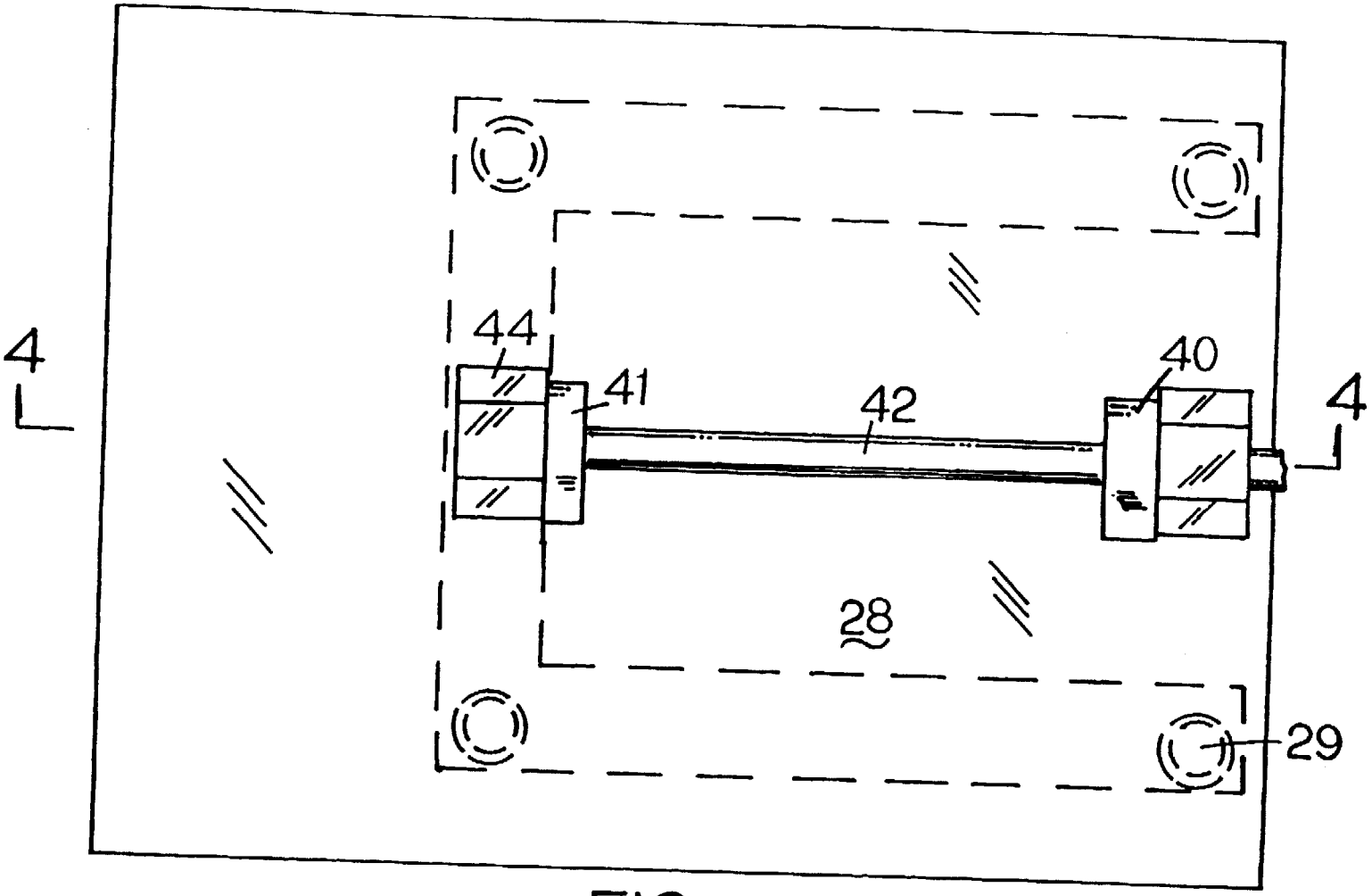
FIG. 3 is a plan view of the support structure FIG. 2 with the work surface in dashed lines to show the cam and axle which vary the height of the work surface.

The work surface 28 rests on the asymmetric cams 40, 41. The work surface 28 is shown in dashed lines in FIG. 3 to illustrate and clarify the location of the cam structure. It will be understood that the actual shape of the cam portion of the cam structure may be altered in the event that more than the 1/4" inch adjustment is required. This also underscores the fact that the present invention is not limited to the dispensing of pills or capsules in order to fill blister packs for later dispensing.

Figure 4:
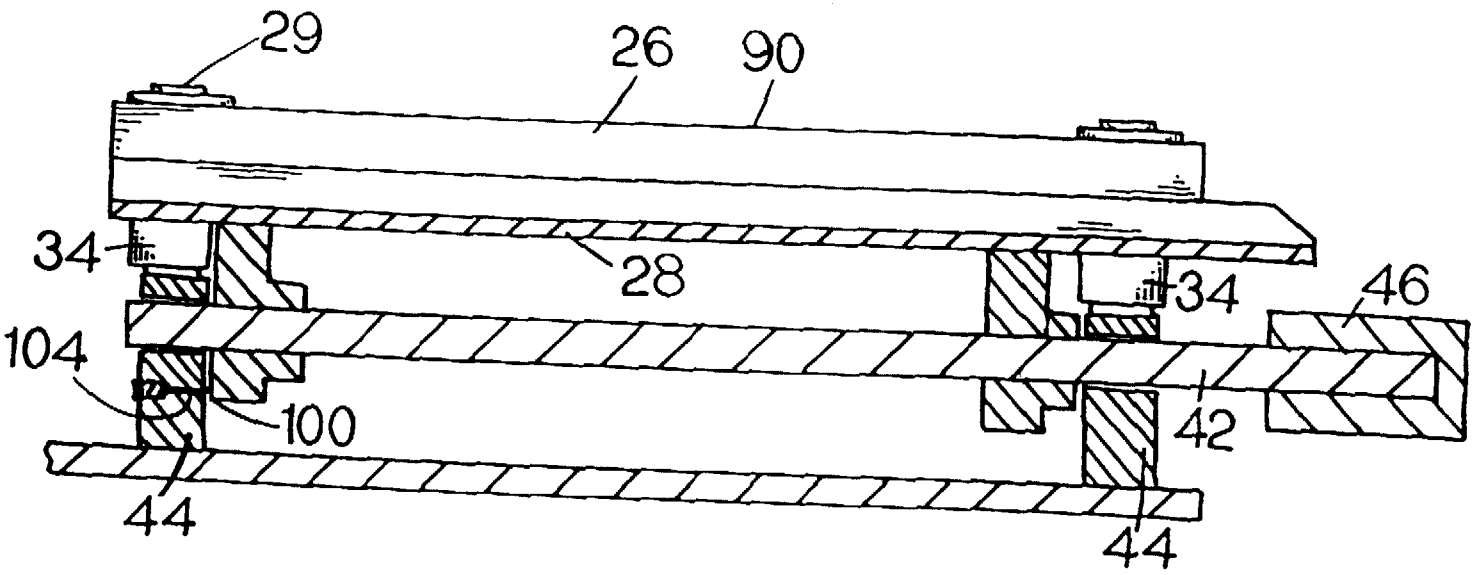
FIG. 4 is a cross section of the structure of FIG. 2 taken along line 4—4 in FIG. 2.

The cams and the corresponding axle 42 are preferably supported by a pillow block 44 mounted to the base 36. A portion of the axle 42 extends beyond the structure 10 and includes a handle or a knob 46 to allow a user to turn the axle 42 and therefore the cams 40, 41. These cams 40, 41 and the axle 42 construction is shown in cross section in FIG. 4.

The cams 40, 41 in the illustrated embodiment are asymmetric in shape. In the presently preferred embodiment one quadrant of both of the cams 40, 41 have a gradually increasing radius, the radius at its longest point being 1/4" longer than at its shortest point.

Figure 8:
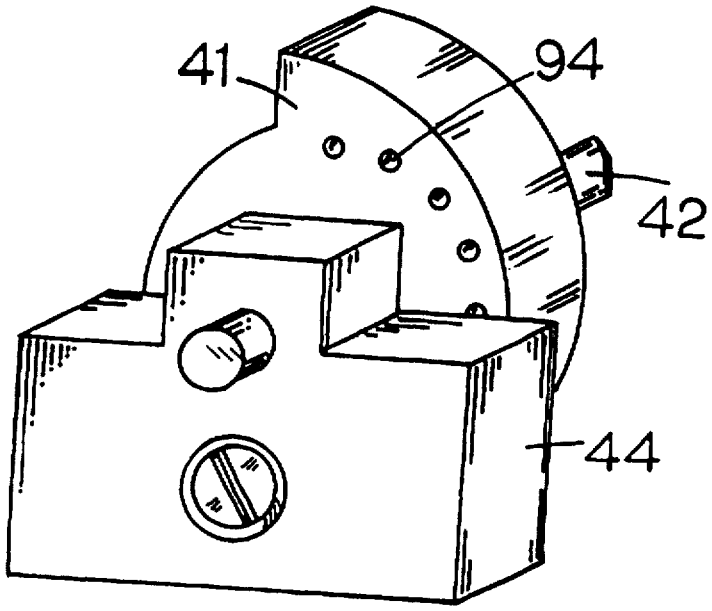
FIG. 8 is a rear perspective view of the cam assembly illustrating the indexing device recesses on the cam face.
Figure 9:
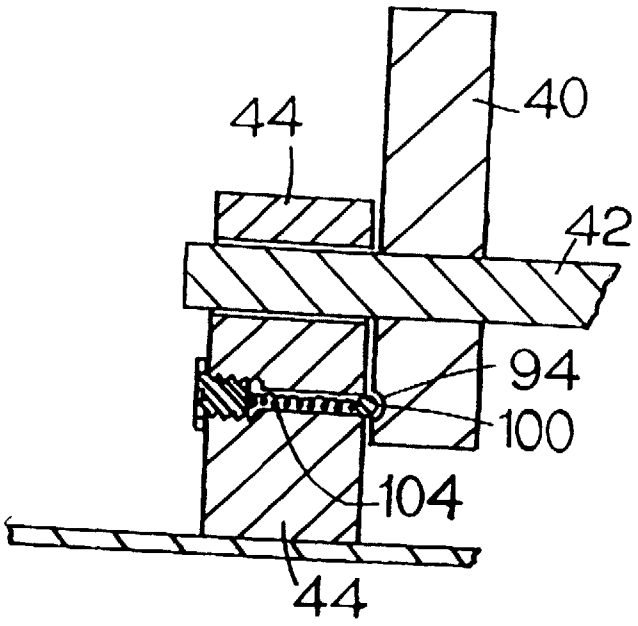
FIG. 9 is a cross sectional view of the cam assembly showing a spring-loaded ball-bearing assembly.

The knob 46 turns the cams so that the radius of cams 40, 41 presented to the work surface increases in discreet 1/32" increments. This corresponds to the industry standard thicknesses of pills and capsules. These increments are accomplished by an indexing device as shown in FIG. 8 and FIG. 9.

The rear cam 41 preferably includes semi-spherical recesses on the rear face of the cam. The portion of the corresponding pillow block adjacent to the cam face or the rear cam includes a spring-loaded ball bearing sized correspondingly to fit within the recesses on the cam face.

As the knob 46 turns the cam 41, the ball-bearing 100 exerts pressure on the cam face. As a cam recess 94 is presented to the ball bearing 100, the spring 104 forces the ball-bearing 100 into the recess 94, "locking" the cam in position. By turning the knob 46 again, the force applied forces the ball bearing 100 back out of the recess 94. The ball bearing 100 then presses against the cam face until another recess 94 is presented.

The nine cam recesses are located in relation to the cam and spring-loaded ball bearing so that each "locked" position corresponds to a 1/32" variation in the cam radius being presented to the work surface.

Figure 5:
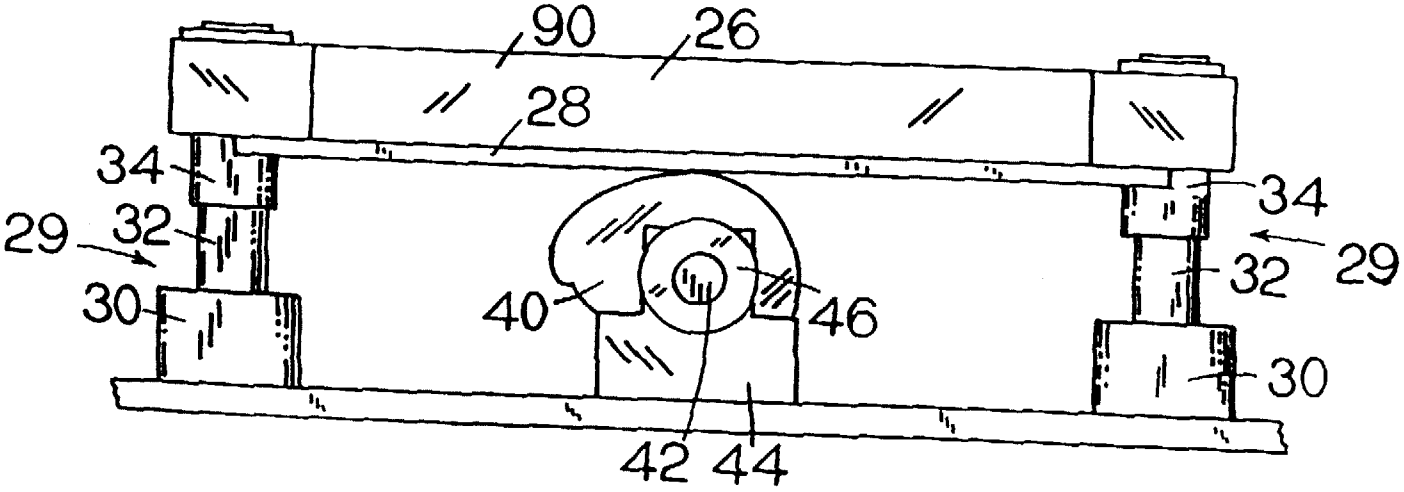
FIG. 5 is a front elevation of the structure of FIG. 2 with the work surface in its lowered position.
Figure 6:
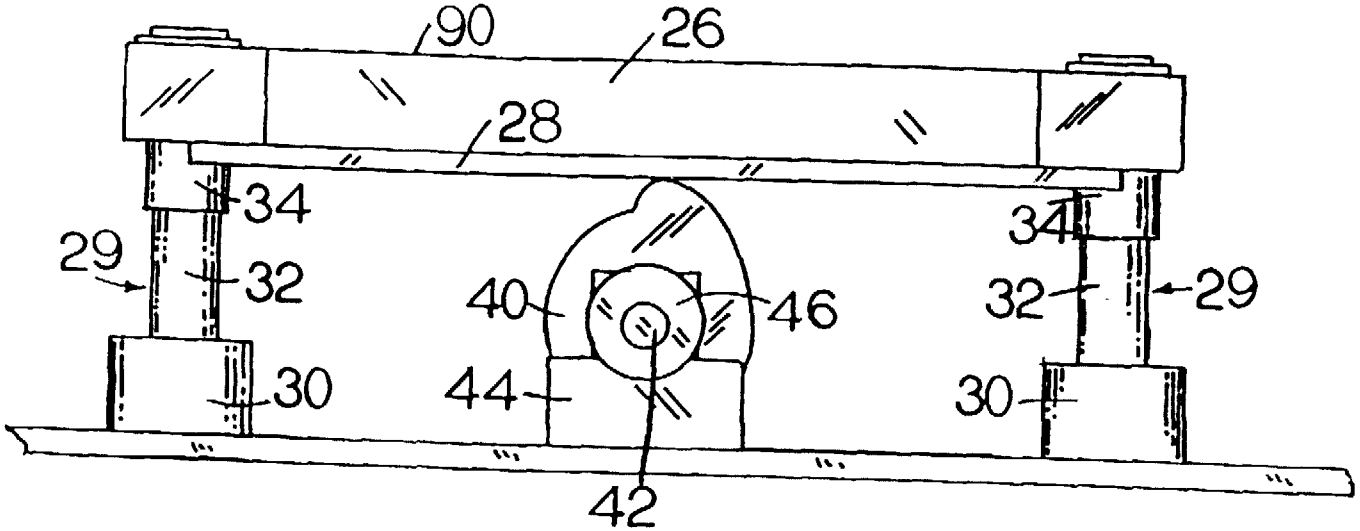
FIG. 6 is a front elevation of the structure of FIG. 2 with the work surface in its raised position.
Figure 7:
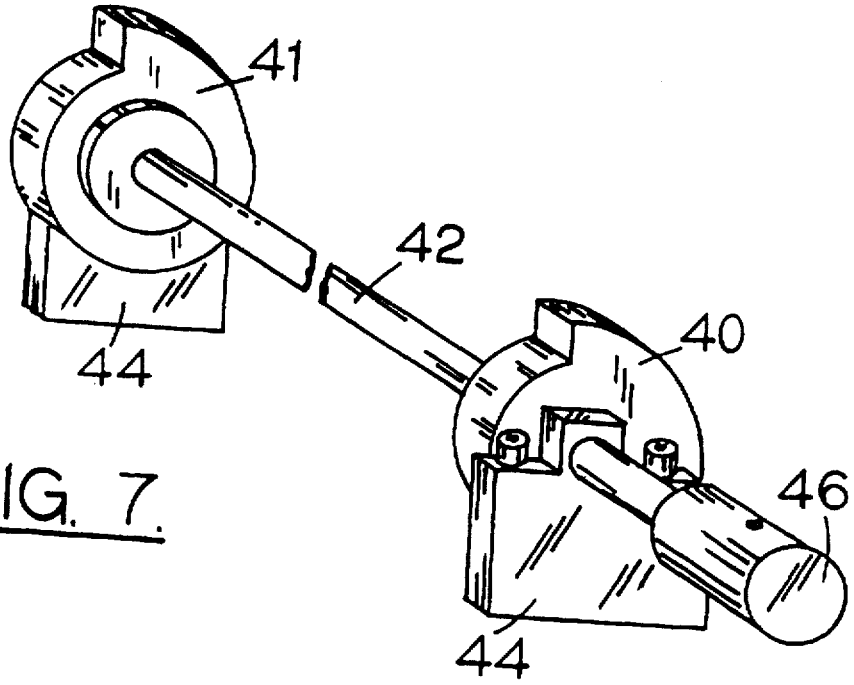
FIG. 7 is a front perspective view of the cam assembly.

FIG. 5, shows the cams 40, 41 positioned so that the shortest radius is presented to and supports work surface 28 so that the work surface 28 is in it lowest position. FIG. 6 shows the cams 40, 41 positioned so that the longest radius is presented to and supports the work surface 28 so that the work surface 28 is in its uppermost position.

In use, the preferred combination dispenser 12 and the support structure 10 includes a desired number of replaceable plates and four replaceable plates are illustrated, each selected for a particular application. The uppermost plate 50, shown in FIGS. 11 and 12, as preferred for the described embodiment, is octagonal and forms the base of the bin 16. Plate 50 includes one or more apertures 52 through which the pill, pills, capsules or pills are swept by the rotating brushes 20.

Figure 11:
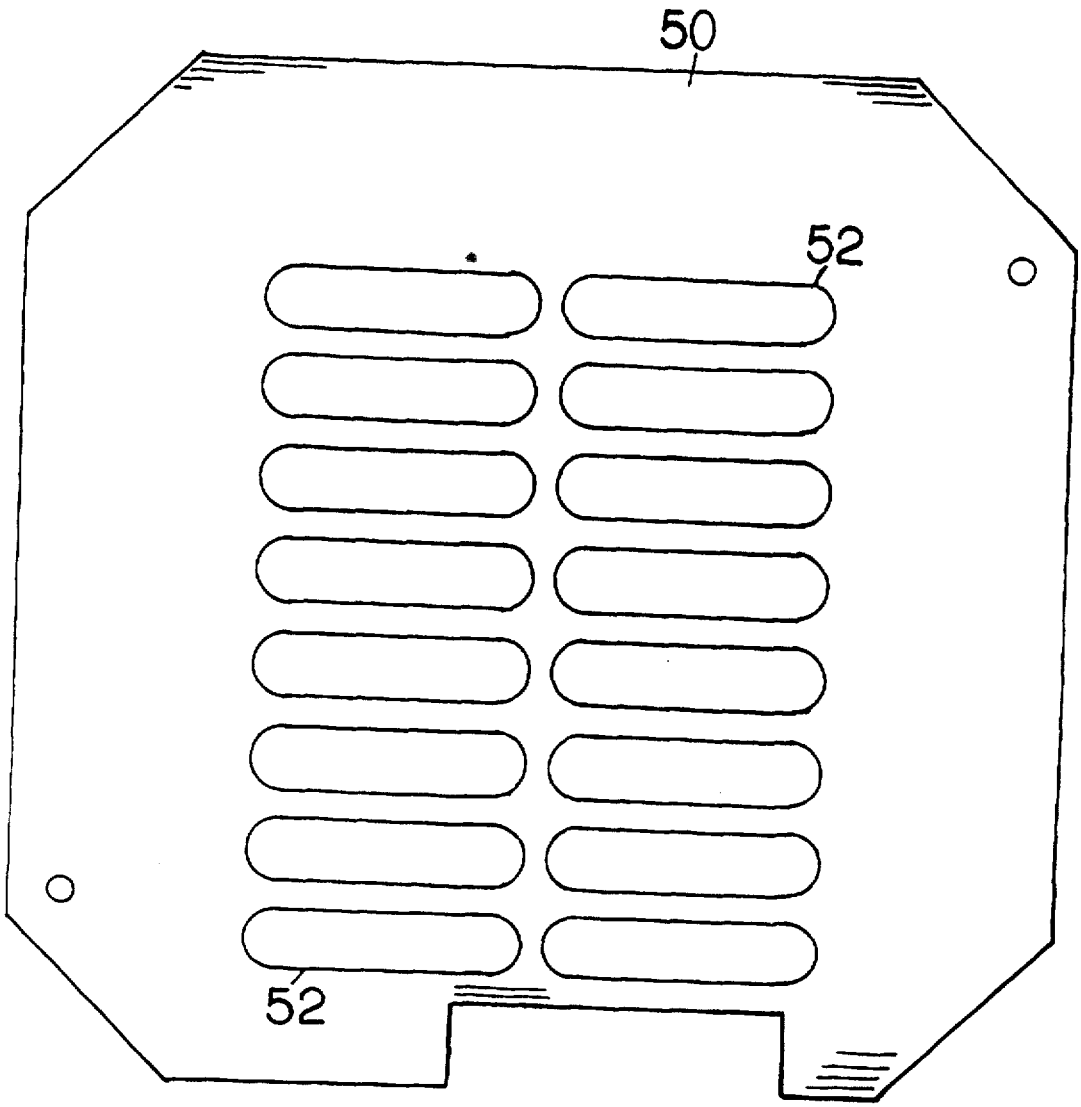
FIGS. 11 and 12 are plan views of apertured stationary plates located below the bin used in the dispenser of FIG. 1, including FIG. 11 illustrating a stationary plate having elongated slots for use in filling a conventional 30 or 31 pill or capsule blister package and FIG. 12 illustrating a stationary plate having apertures or openings arranged for filling a conventional 90 pill or capsule blister pack.
Figure 12:
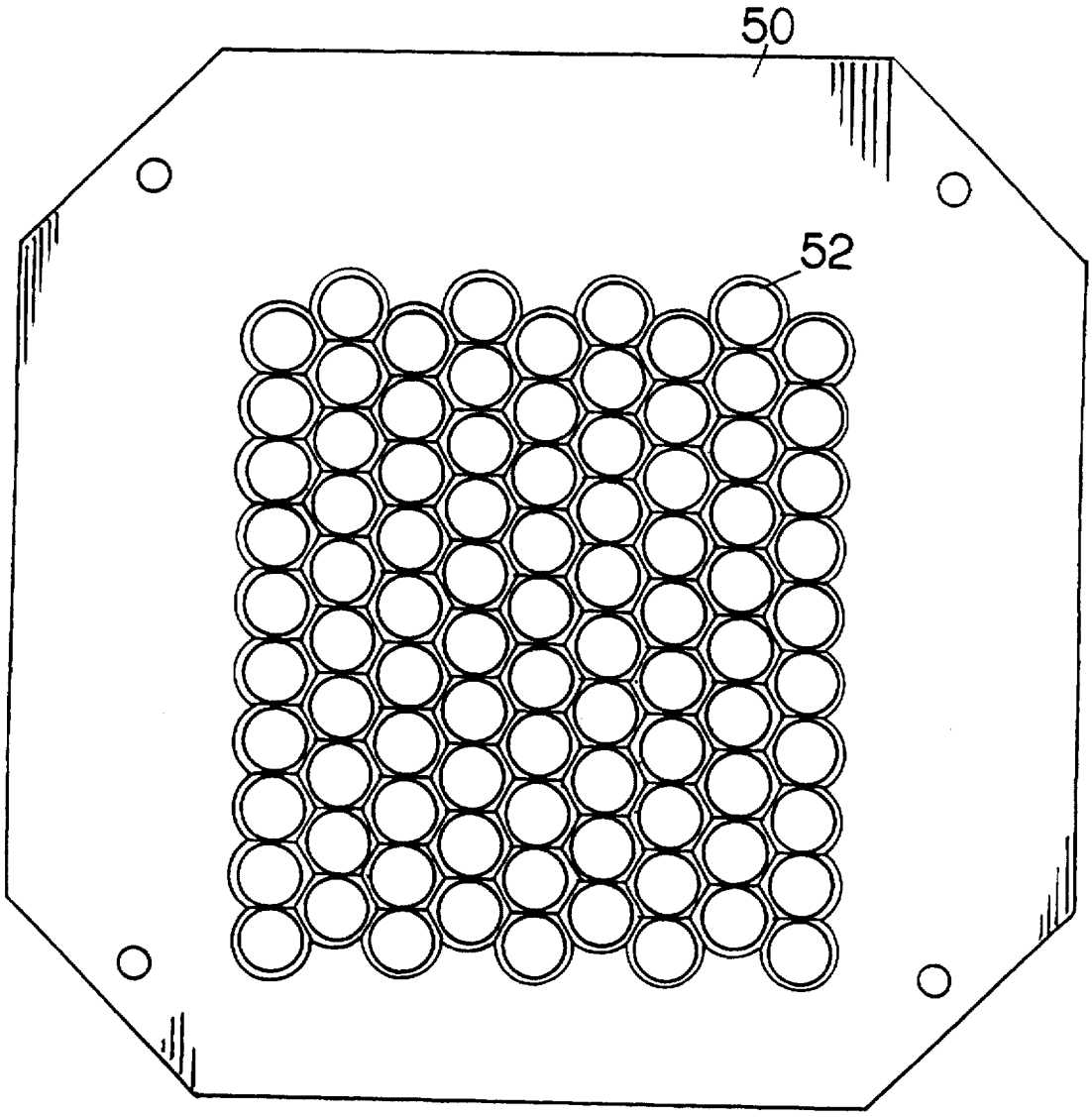

FIG. 11 illustrates a plate 50 with apertures 52 for ultimately dispensing pills or capsules into blister packages of either thirty (30) or thirty-one (31) openings. FIG. 12 shows a plate for use when the blister package has ninety (90) pills or capsules. It will be understood by one skilled in the art that the plate 50 is readily modified for use with the desired blister packages.

Figure 13:
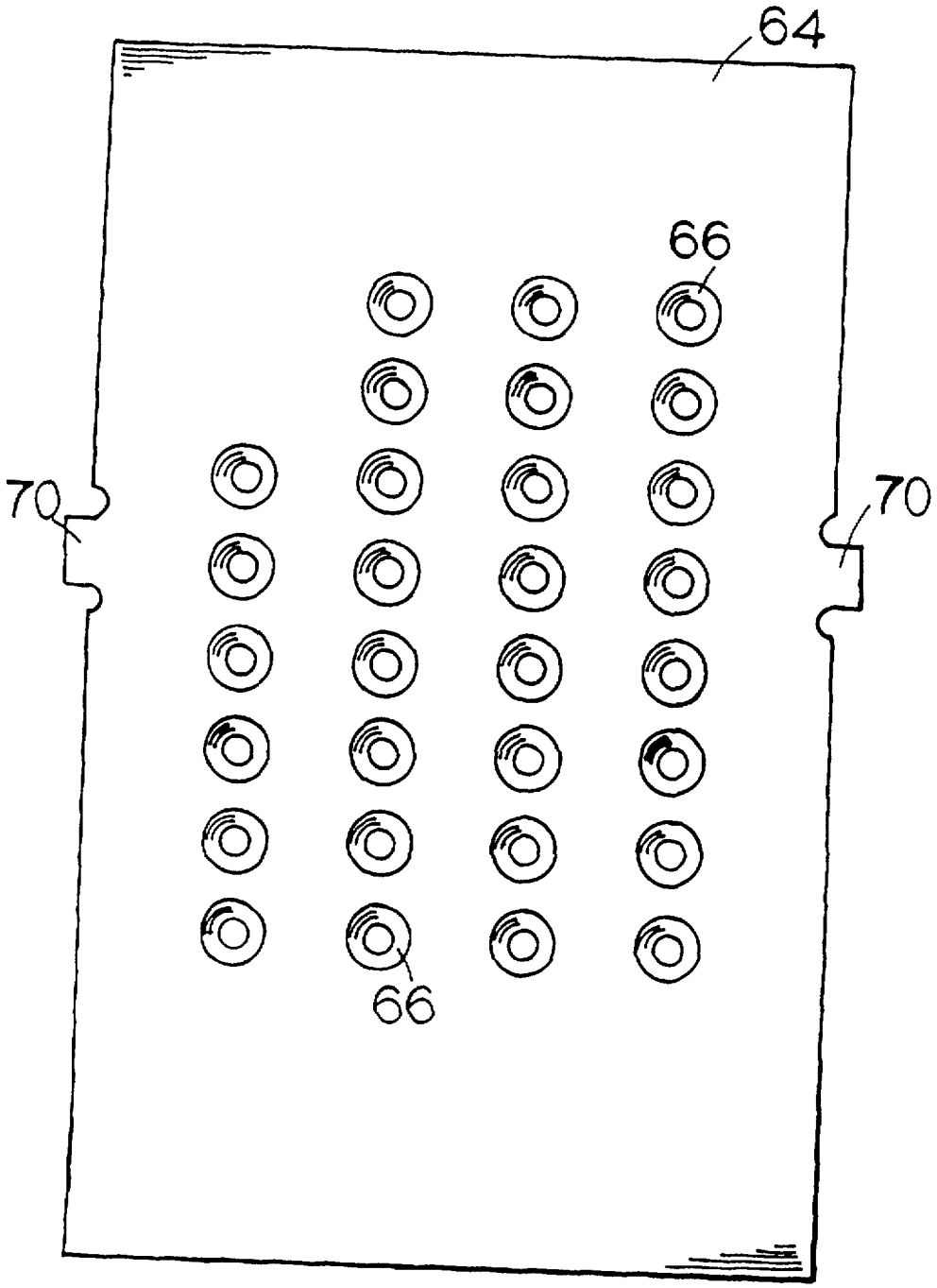
FIGS. 13, 14 and 15 are plan views of the shuttle apertured plate openings, used in the dispenser of the present invention depicted in FIG. 1 with FIG. 13 illustrating the pill or capsule shaped aperture for filling a conventional 30 pill or capsule blister package, FIG. 14 illustrating an apertured plate for filling a conventional blister package with 90 relatively small pills or capsules, and FIG. 15 illustrating an apertured plate for filling a conventional blister package with 90 relatively larger sized pills or capsules.
Figure 14:
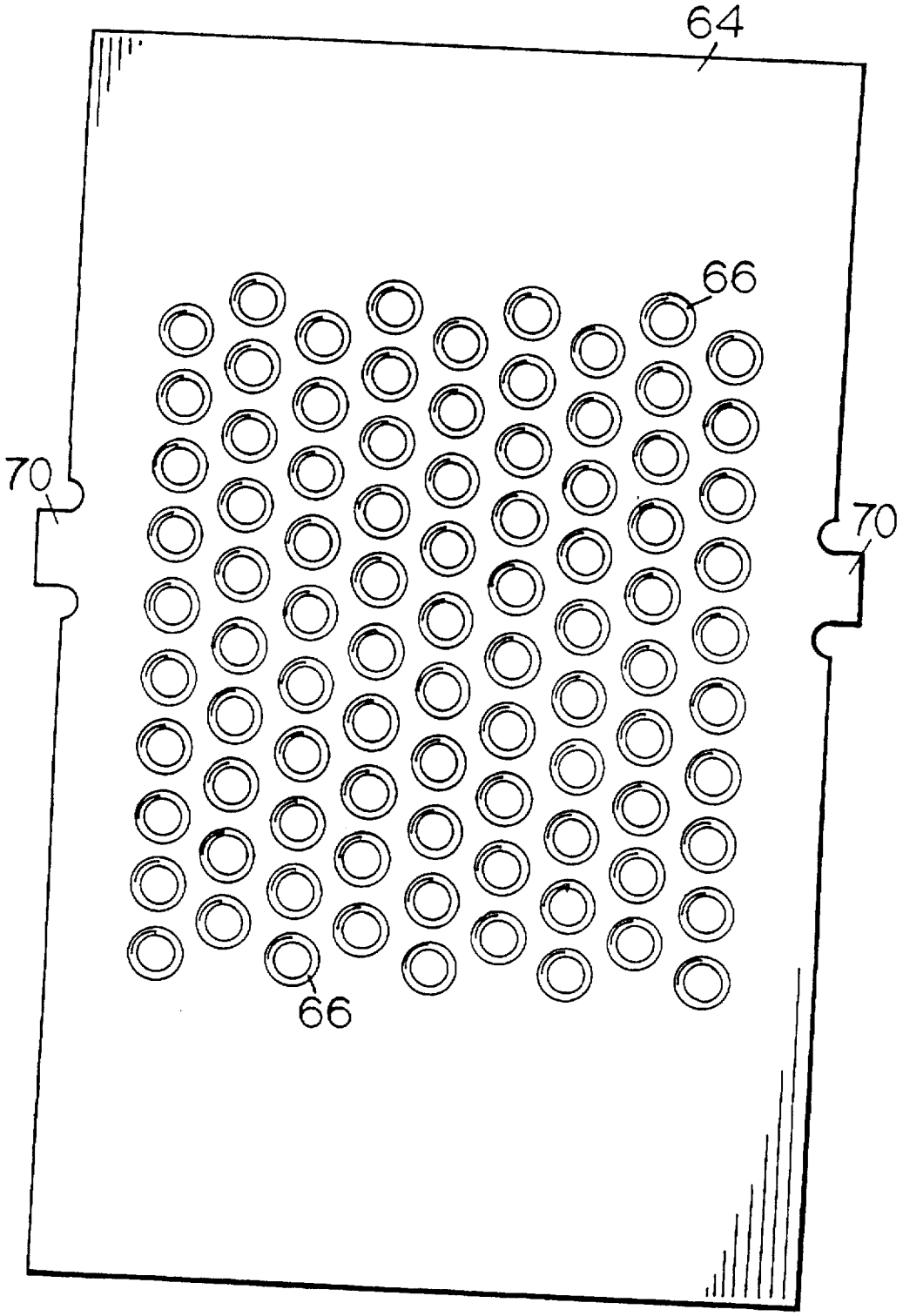
Figure 15:
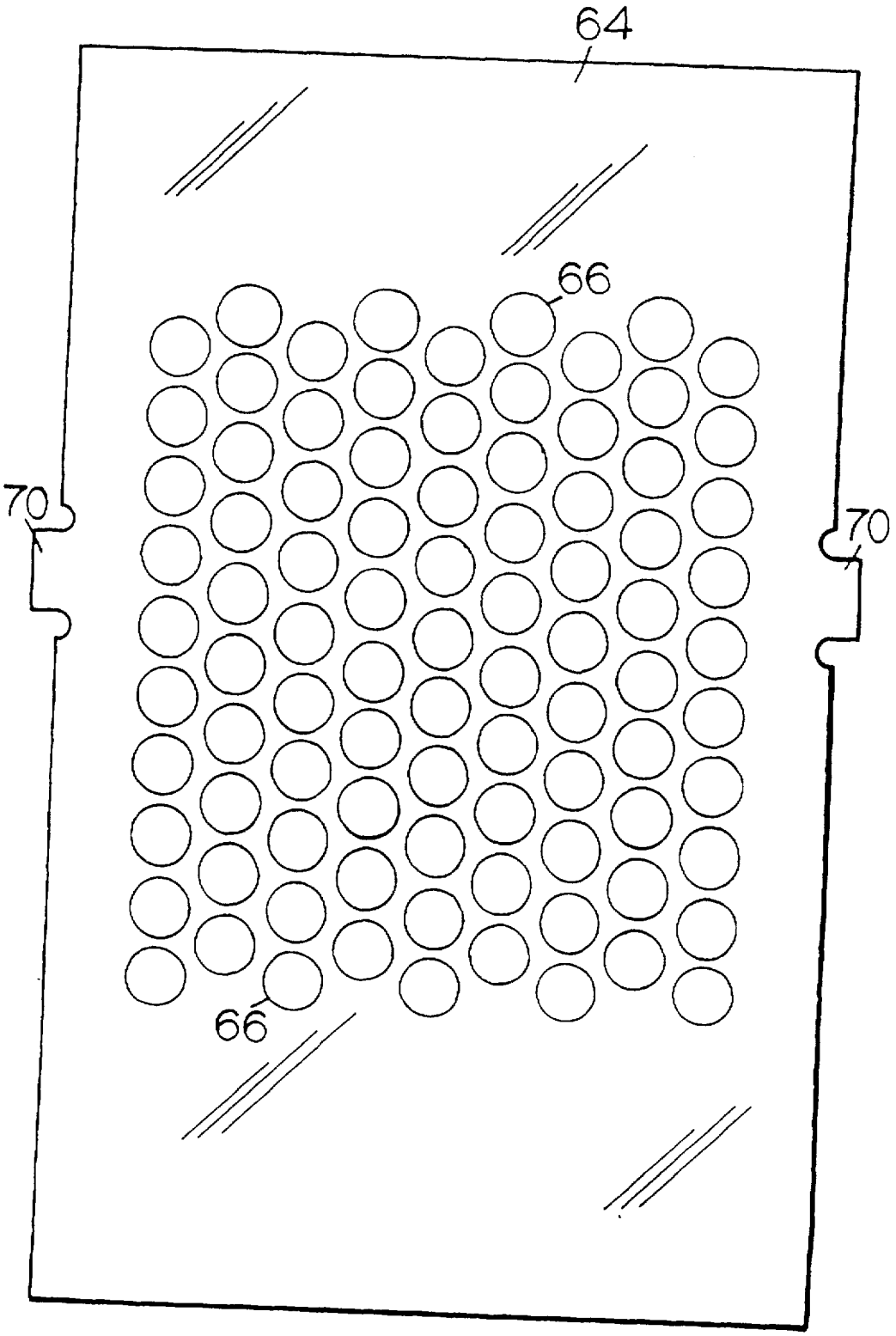

A shuttle plate 64 shown in FIG. 13, FIG. 14 and FIG. 15 has openings 66 generally corresponding to the size and/or thickness of the pills or capsules to be dispensed.

FIG. 13 generally illustrates a shuttle plate 64 used when filling blister packages of thirty (30) pills or capsules. It will be understood that this shuttle plate can be further modified to add another opening for use when filling blister packages of thirty-one (31) pills or capsules. FIG. 14 generally illustrates a shuttle plate 64 for use in filling blister packages of ninety (90) pills or capsules. FIG. 15 generally illustrates another embodiment of a shuttle plate 64 for use when filling blister packages of ninety (90) pills or capsules.

The shuttle plate 64 includes projections or ears 70 which fit into receiving notches 84, 86 of the recessed ledge 82. The projections or ears are of a width sufficiently less than the notches 84, 86 so as to allow movement of the shuttle plate 64 in a front-to-back horizontal direction.

Figure 16:
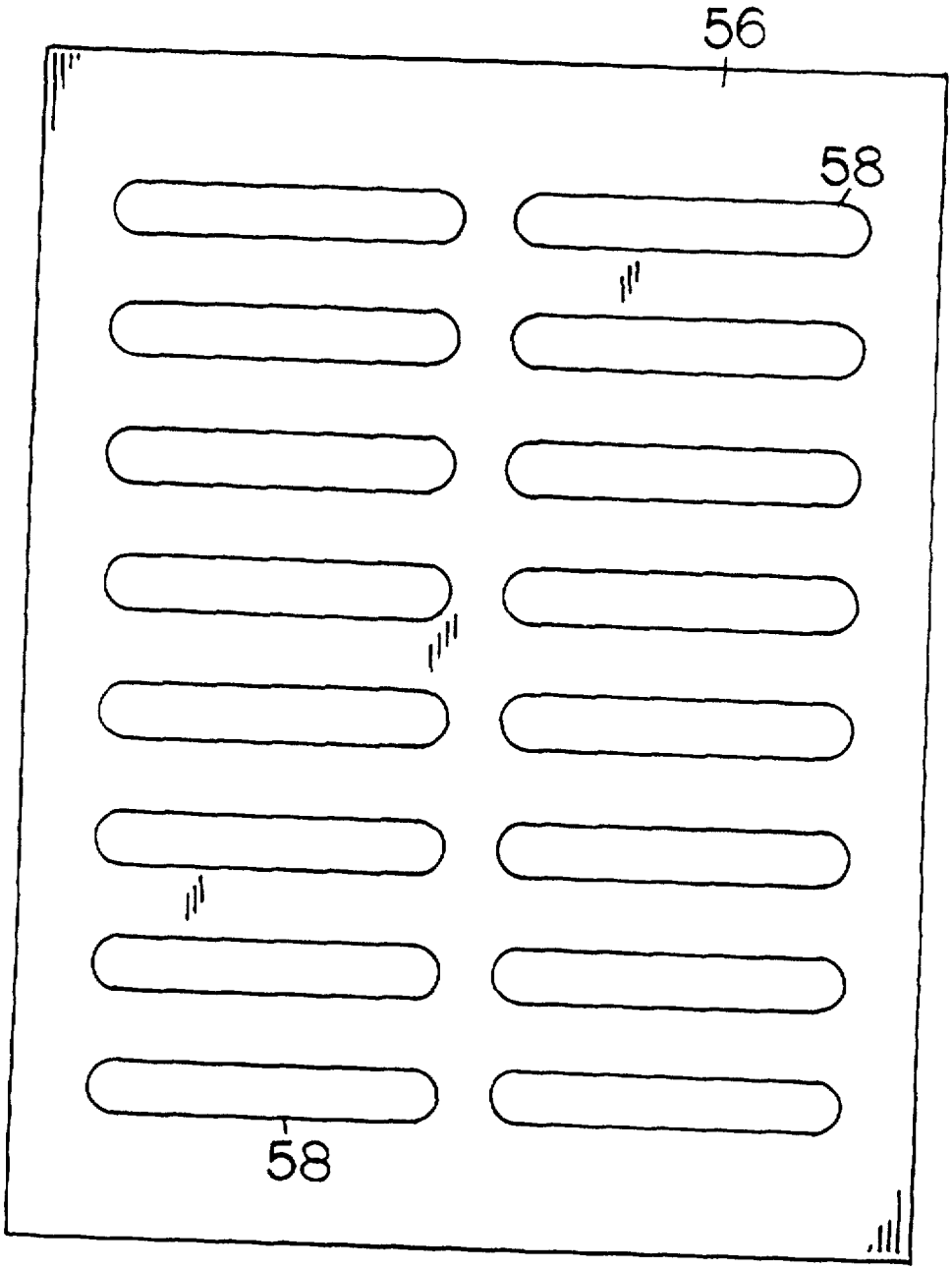
Figure 17:
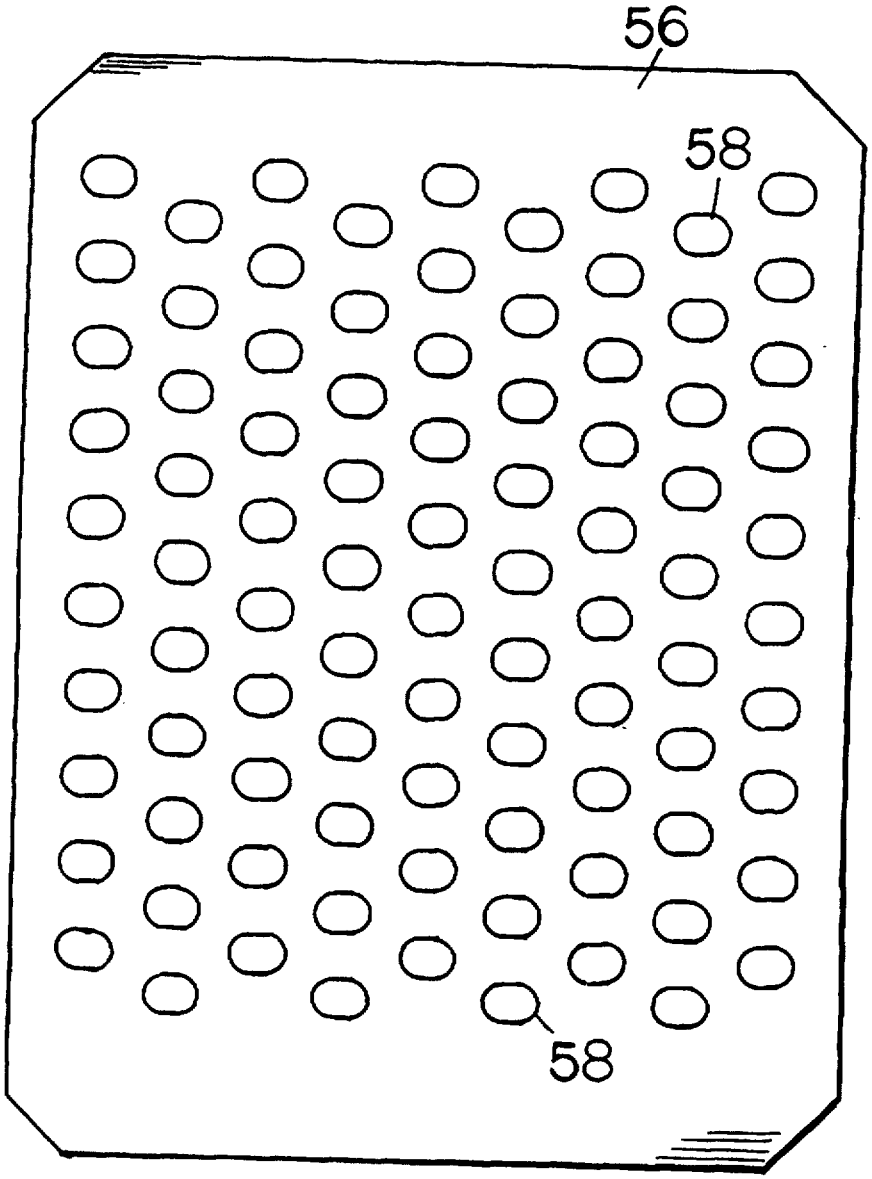
Figure 18:
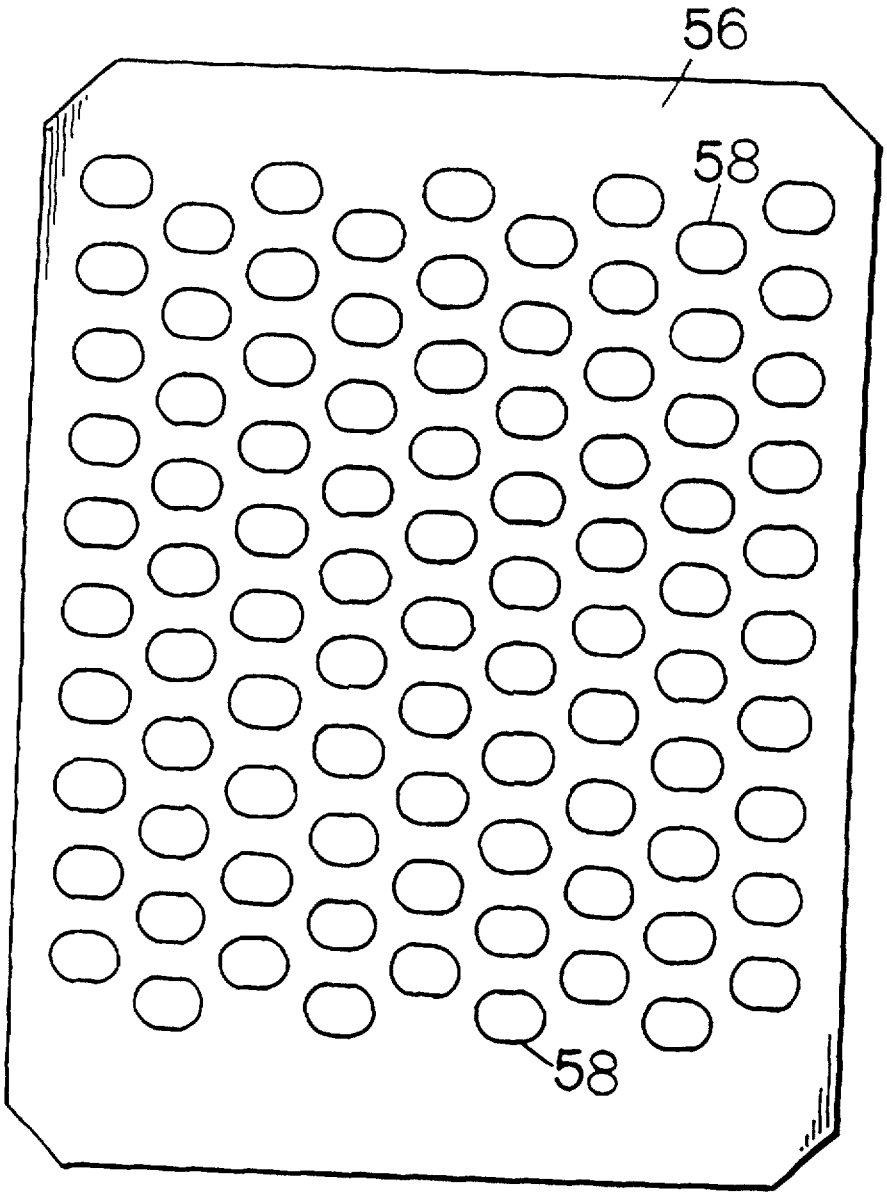

A dispensing plate 56, shown in FIGS. 16, 17 and 18, has apertures 58 corresponding generally to the shape of the pills or capsules being dispensed. The plate 56 of FIG. 16 is used when dispensing pills or capsules into blister packages of either thirty (30) or thirty-one (31) count, while the dispensing plates illustrated in FIGS. 17 and 18 are shown to illustrate the dispensing plates used when dispensing relatively smaller and larger pills or capsules into ninety (90) count blister packages.

Figures 19, 20:
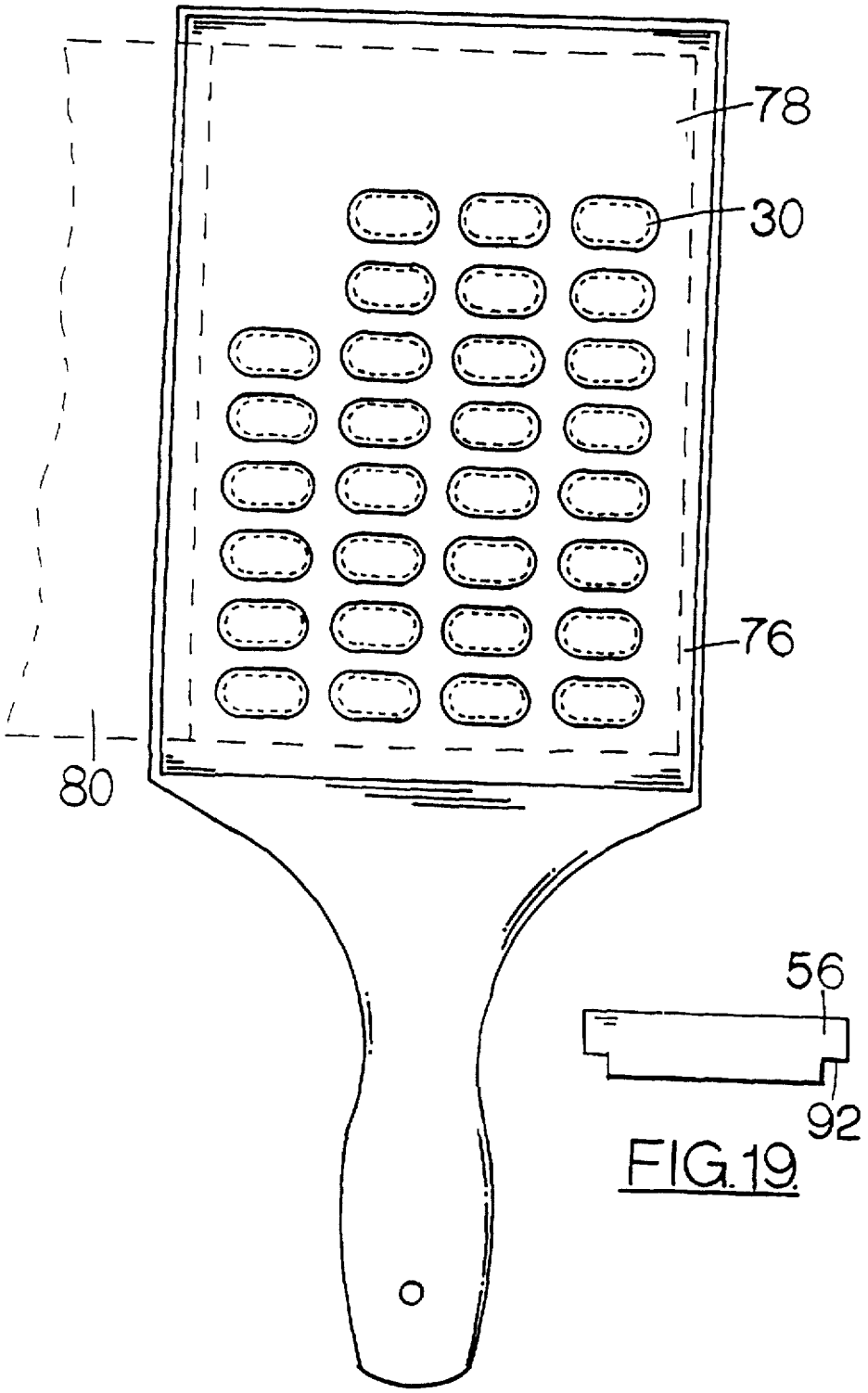
FIG. 19 is a typical end view of the dispensing plate illustrating one embodiment of a shoulder arrangement on the sides of the dispensing plate in which the shoulder facilitates the insertion of the dispensing plate into the supporting frame member.
FIG. 20 illustrates a view of a blister pack paddle used in concert with the other plates by an operator of the dispenser structure and supported by the dispenser structure of FIG. 1.

Each dispensing plate 56 preferably includes a shoulder portion 92 along opposing outer side edges as generally illustrated in FIG. 19. When assembled the upper horizontal portion of each of the shoulder portions 92 are intended to rest on framing portion 90. This arrangement is one preferred embodiment for maintaining the desired alignment. It will be understood that other alignment arrangements are possible.

It will be understood from filling conventional blister packages or cards with conventional filling devices that the shape of the apertures of this and the other plates may vary without effecting the scope of the present invention.

It will be further understood that it would not be possible to illustrate every combination of number and size of holes. A particular arrangement can readily be formed when the size and number of pills or capsules and the blister package or card arrangement is known. Thus, one skilled in the art will now realize how the present invention can be readily adapted for as yet unknown pill or capsule size and number.

The fourth plate is a conventional paddle 76 as shown in FIG. 20. The paddle 76 supports a blister pack 78, including one or more molded blister package recesses 80 to be filled.

The plates are assembled as follows. Each blister pack 78 to be filled is positioned on its respective paddle 76 and the paddle is inserted. The paddle 76 is supported by the adjustable height work surface 28 of structure 10.

The dispensing plate 56 is positioned above the paddle 76, with its shoulders 92 resting in the notches 92 of framing portion 90. The height of the support structure 10 is then adjusted as described below to correspond to the thickness of the pills or capsules to be dispensed.

The shuttle plate 64 is positioned above the dispenser plate 56. The spring device 88 is mounted relative to the recessed ledge 82 and is depressed as the shuttle plate 64 is moved into place. The projections 70 are aligned with and fit into the notches 96 defined by the recessed ledge 82.

When the force used to depress the spring device 88 is released, the bias of the spring device 88 forces the shuttle plate 64 back toward the front of the dispenser 12. The movement or displacement of the shuttle plate 64 is limited by the interference between the edges of the notches 96 and the projections 70 located in the notches.

The upper plate 50 is then mounted on the U-shaped cover surface 14, between the cover surface 14 and the bin 16 which is held in place by tabs 15.

To dispense pills or capsules, the appropriate plates form a group of available plates that are selected and assembled as previously described. The distance between the work surface 28 supporting the dispensing plate 56 and the shuttle plate 64 is then adjusted to allow for the thickness of the plates and the size and shape of the pills or capsules being dispensed.

Without the aforementioned adjustment, the thickness of the particular adjacent plates chosen for the job and the thickness and/or shape and/or size of the pills or capsules intended to be dispensed could interfere with or even prevent the intended dispensing and filling of blister packages. Furthermore, this vertical height adjustment allows the apparatus of the present invention to be used for the same count but different size and/or shape pills or capsules to be dispensed with only the vertical height adjusted as taught herein.

The height of the support structure 10 is adjusted by turning the knob 46 on axle 42, the 1/32" increments in the height of work surface 28 corresponding to the standard variation in pill or capsule thickness. It will be understood that other increments and total adjustment may vary depending upon the application in which the present invention is used.

The bulk volume of the object to be dispensed is located in the collar bin 16. The rotation speed of the mixing rods 18 and brushes 20 is then selected when the mixing motor is turned on.

The speed of the motor and brushes may be changed during the process if necessary to effect the movement of the pills or capsules within the bin 16.

The brushes then sweep the pills or capsules over the apertures or openings of the first plate 50, and gravity acts on the pills or capsules which then fall through the apertures 52 and into the apertures or openings 66 of the shuttle plate 64 when the shuttle plate is in a receiving position.

The shuttle plate 64 is then moved by applying a force against the spring mechanism. When the shuttle plate openings 66 are in vertical alignment with the dispensing plate 56 and its openings or apertures 58, then the pills or capsules fall through the dispensing plate 56 and into the molded recesses 30 of the blister package 78. The shuttle plate is then allowed to move back to its original biased position by the spring device.

The filled blister packages 78 in the paddle 76 are replaced with another un-filled blister packages 78, which can be accomplished by either replacing the blister package or the entire paddle 76 and blister package combination.

This is a brief summary of the operation of conventional dispensing apparatus as well as the apparatus of the present invention. The operation of the present invention is described below.

When a pill or capsule of a differing shape or thickness is to be dispensed, the appropriate plates are inserted and the work surface height adjusted correspondingly. The ability to adjust the height of the work surface as shown and described herein provides an efficient and time saving manner in which the pills or capsules of varying thicknesses and shapes are allowed to be dispensed by the same machine without completely dismantling or extensively modifying the dispenser 10.

Figure 21:
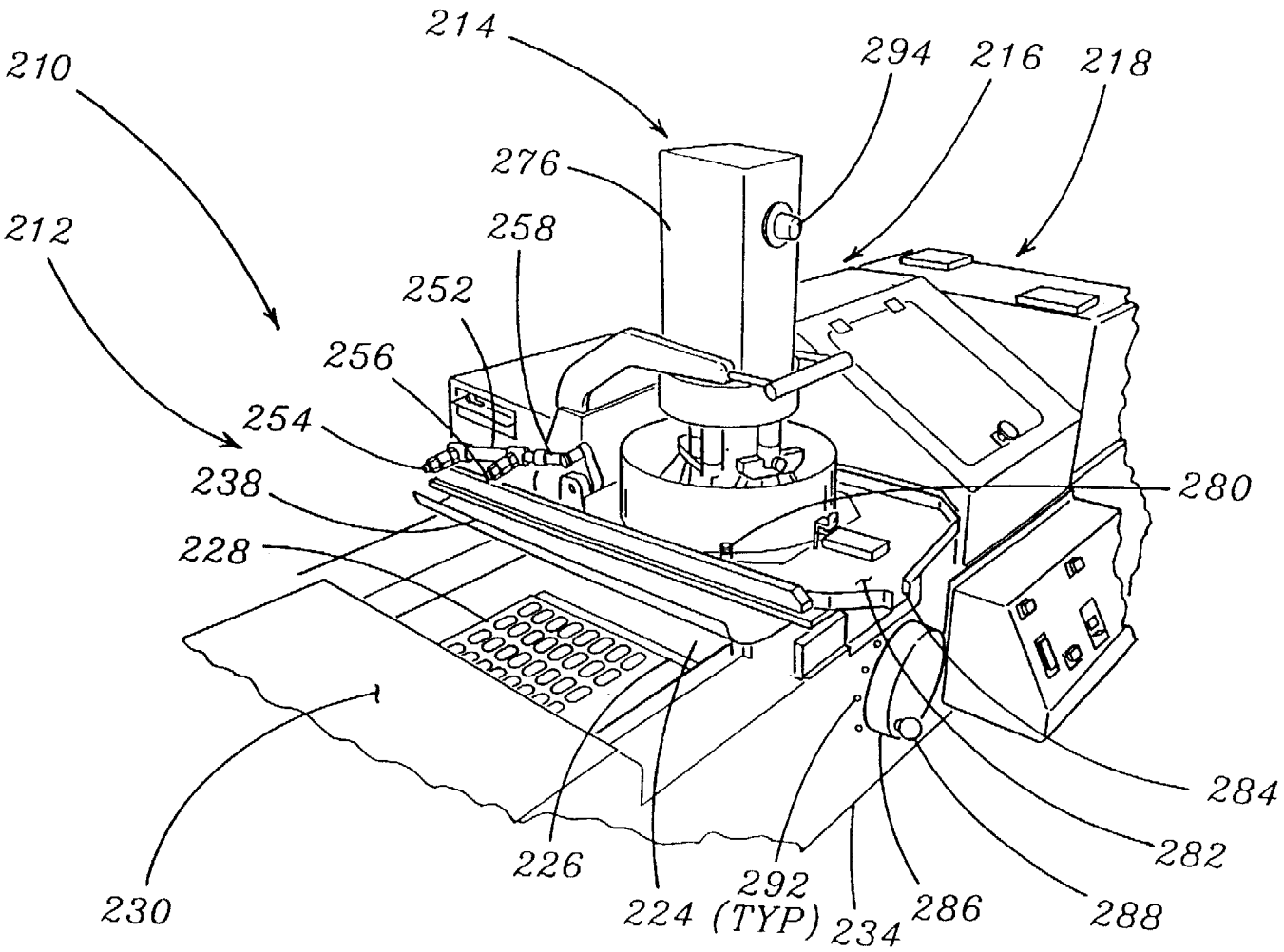
FIG. 21 illustrates a perspective view of the apparatus 210 constructed in accordance with the present invention.

Improved Pill and Capsule Card Apparatus Incorporating Modified Pill Card Filling Unit Referring now to the additional drawings, starting with FIG. 21 and photographs in the Appendix there is shown a preferred embodiment for the improved pill or capsule filling apparatus of this invention. The pill or capsule filling apparatus of the present invention is particularly adapted for providing an automated process for filling, folding, sealing and printing indicia on a pill card and is characterized by an improved amalgamation of components and method of operating the resulting apparatus.

The drawings starting with FIG. 21 and the photographs show the apparatus 210 in conjunction with a pill card (the "card") loading station 212, card filling station 214, card folding station 216, card sealing station 218, card printing station 220 and card unloading station 222 located behind 218. The card filling station comprises a card filling device described above and illustrated in FIGS. 1–20 modified for automatic operation as further described and illustrated herein.

These stations comprise the apparatus of the improvement of the present invention. The primary components of each station will now be described in turn in the order in which they take part in the process of the present invention.

Figure 22:
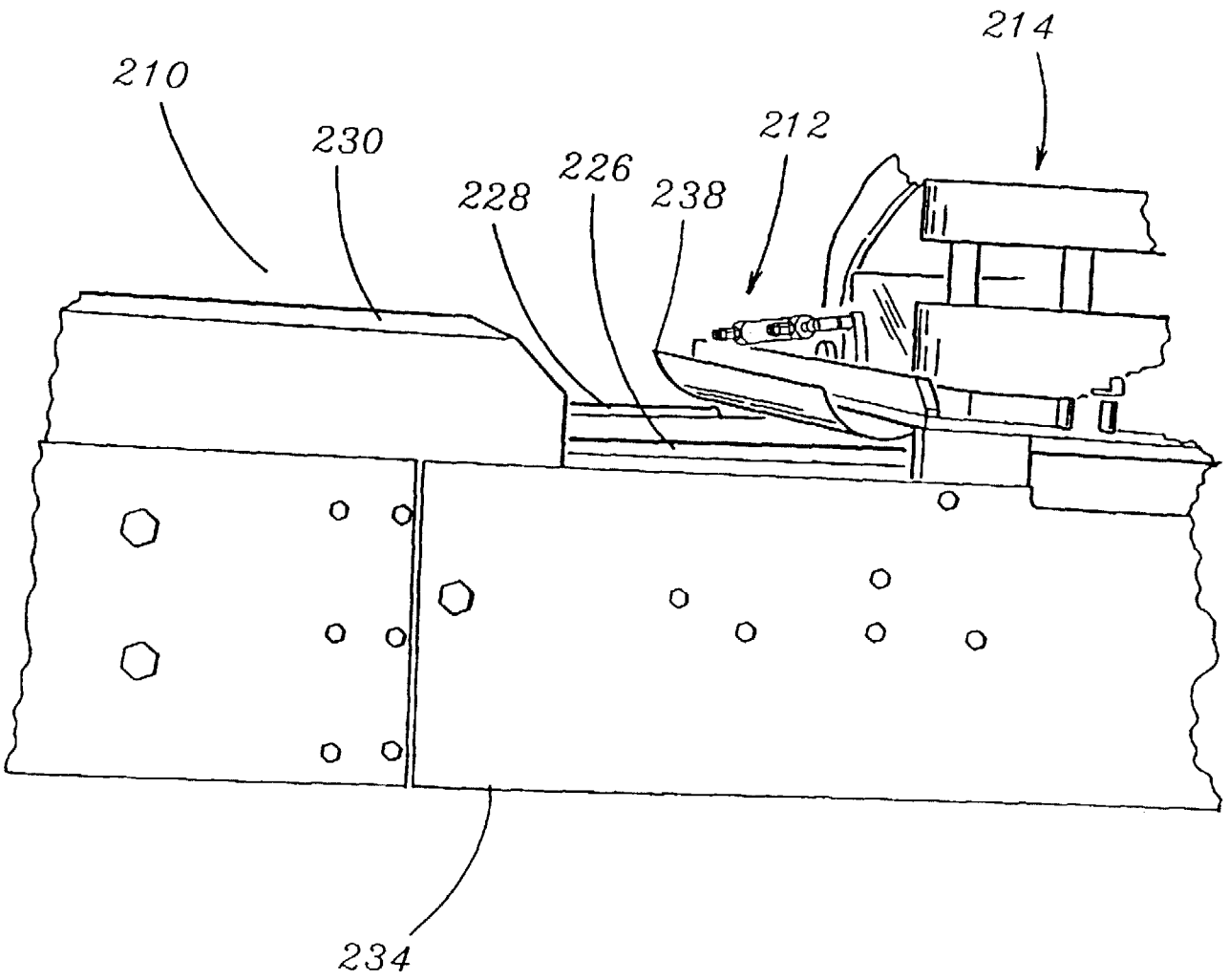
FIG. 22 is a partial elevational view of a feeding and filling station of the present invention.

FIG. 21 illustrates a perspective view of the apparatus 210 constructed in accordance with the present invention and illustrating the various stations 212 through 222. Photographs A-I and A-II show the same portion of the prototype as illustrated in FIG. 21 and FIG. 22.

The loading station 212 comprises a pill card paddle endless conveyor 224 for conveying a paddle support frame 226 sized to securely hold a modified pill card paddle 228. A protective housing 230 is provided to provide a barrier between an operator of the apparatus 210 and an end of the conveyor (not shown) as it reverses to present the first station 212 with each empty pill card paddle.

The width of the apparatus 210 is sufficient to receive an empty pill card with its cover surface open (and preferably to the rear of the machine). In this way the path of the modified paddle 228 carrying an empty pill card is not obstructed until it reaches the pill card folding station 216.

Figure 23:
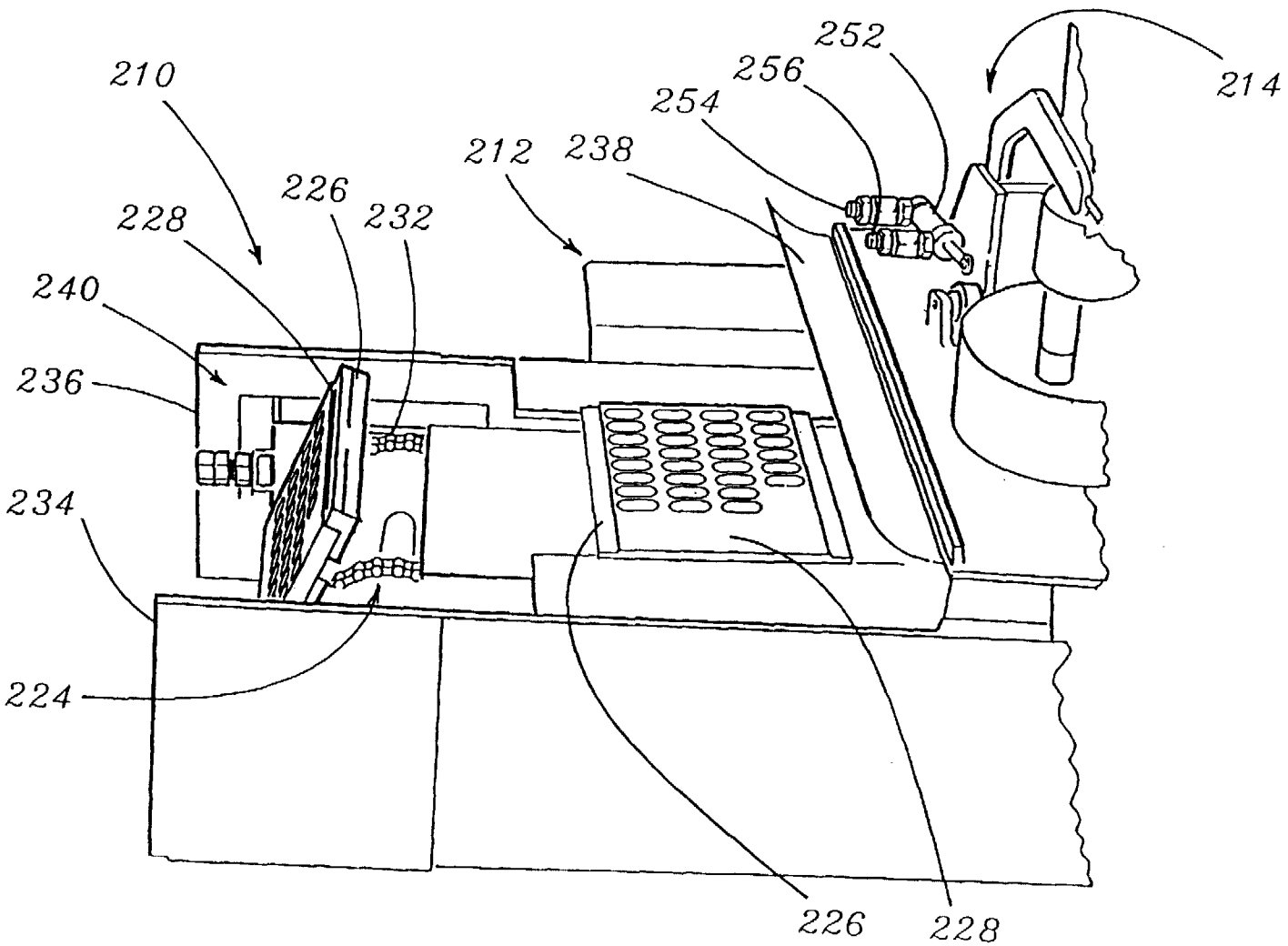
FIG. 23 a partial elevation of an end of the apparatus from the perspective of the filling station end.
Figure 24:
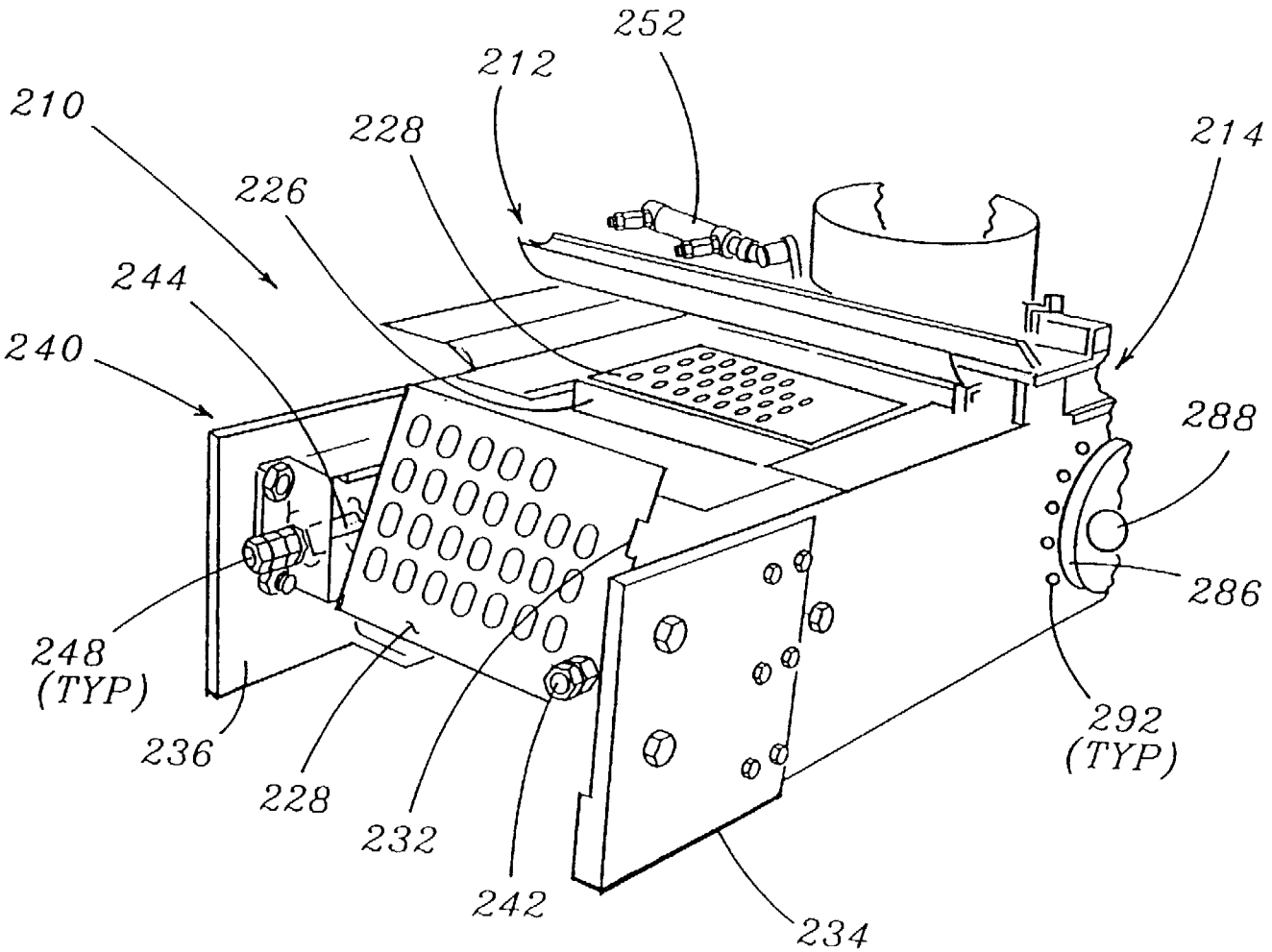
FIG. 24 is another partial elevation of the end of the apparatus of the present invention further illustrating an end of a conveyor showing the movement of an empty paddle from a lower course to an upper course.

Protective housing is removed in FIGS. 23 and 24 to show the apparatus and in particular the conveyor 224 (see photographs A-III and A-IV). In the preferred embodiment the conveyor comprises a chain and sprocket assembly generally illustrated at 232.

The apparatus 210 is framed by opposing side members 234 and 236 which generally support the equipment and components at each of the stations. The opposing side members also serve to support the conveyor 224, associated chain and sprockets 232 and any necessary shafts and bearings to provide support for both the upper and lower paths of the conveyor.

A tensioning assembly 240 is provided to allow adjustment of chain tension and proper alignment of the paddles at each of the stations. The chain tensioning assembly comprises a pair of opposing longitudinal shafts 242, 244 mounted in a pair of movable support structures 246 (only one illustrated).

The opposing shafts are at least partially threaded and receive one or more nuts 248. The nuts are used to adjust and then lock the shafts until further adjustment is required.

A jam plate 238 is located between the pill card loading station 212 and the fill station 214. In the preferred embodiment the jam plate is curved upwardly from the path of the conveyor and pill card and mounted on a suitable hinge or shaft.

A pill card that does not remain flat as it is conveyed on its paddle moves or pivots the jam plate. Moving or pivoting the jam plate causes an air brake (not shown) to operate and stop the conveyor before the non-flat empty pill card can be conveyed to the fill station and jam the apparatus.

The next station is the pill card fill station 214. The description of the basic pill card filling apparatus 250 is found in co-pending application, Ser. No. 136,468, filed Oct. 13, 1994 which is incorporated herein by reference.

It is deemed necessary to describe only the modifications to the pill card filling apparatus 250 in order for one skilled in the art to understand and appreciate the improvement of the present invention. The same nomenclature will be used where possible and expedient but a detailed description of the pill filling apparatus 250 of fill station 214 is not deemed necessary.

The drawings show the preferred embodiment of the variable height support structure generally designated 250 at its fill station 214. It will be understood from the drawing figures and photographs in the Appendix that variable height support structure of the filling apparatus has been modified to adapt to the apparatus 210 of the present invention.

The modified paddle 228 and the unfilled pill card (not shown) move by conveyor in one side and out the other while in the stand alone device the paddle is moved in and out from the front of the stand alone device. The manually operated shuttle of the previously described embodiment is operated by an external power system (compressed air in the presently preferred embodiment described herein) as is the conveyor.

Figure 25:
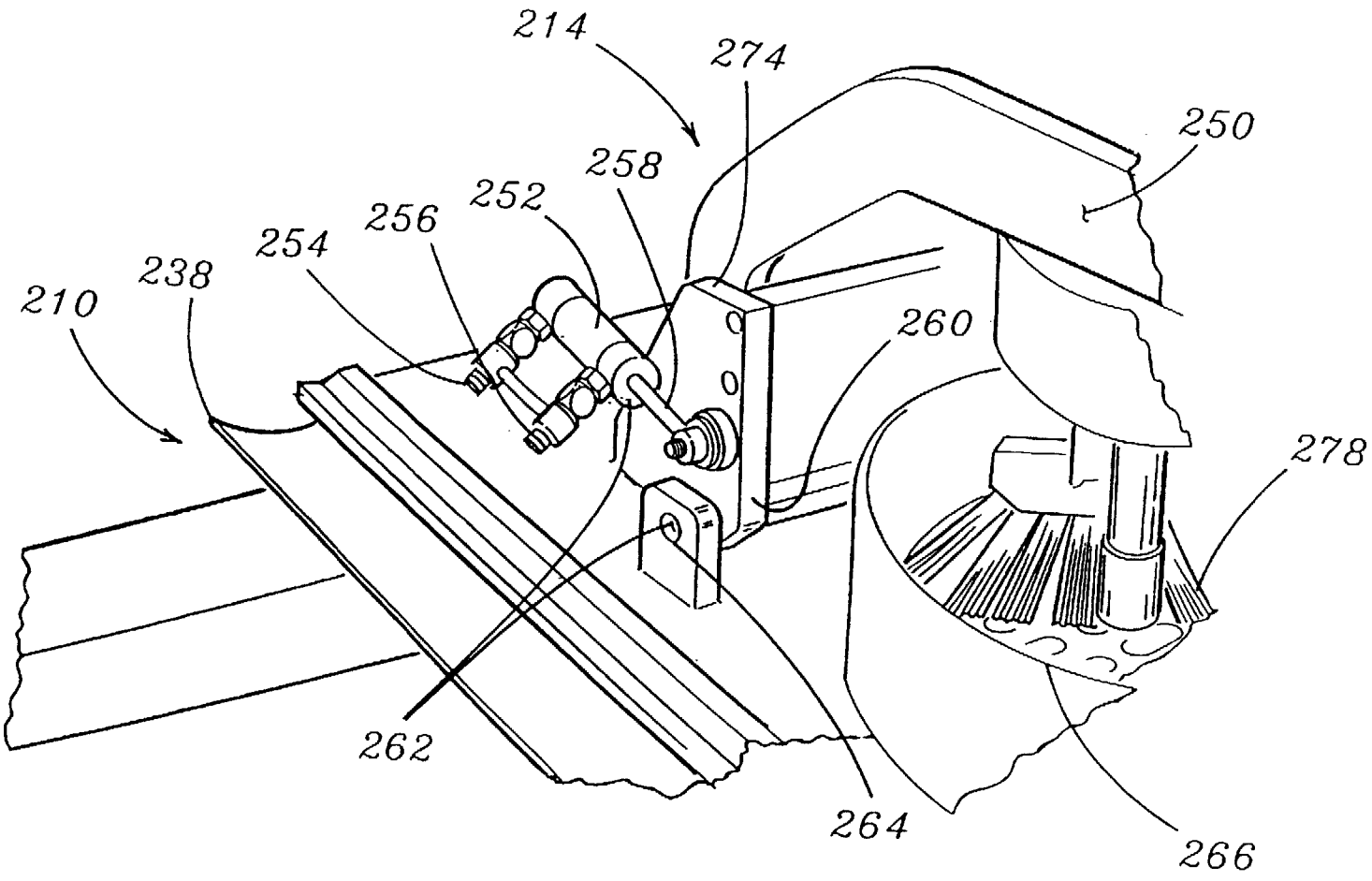
FIG. 25 is a partial elevational view of the pill card filling unit.

The powered filling operation of the present invention is better understood from FIG. 25 and A-V which shows a double acting pneumatic piston 252 with compressed air connections 254, 256. A shaft 258 extends from the piston 252 and is attached to a crank arm 260.

The crank arm 260 pivots at 262, for example mounted in a suitable bearing 264. The crank arm is coupled with and moves a shuttle located below a pill or capsule hopper 266 which holds the pills or capsules (not shown) with which the empty pill cards are to be filled.

Figure 26:
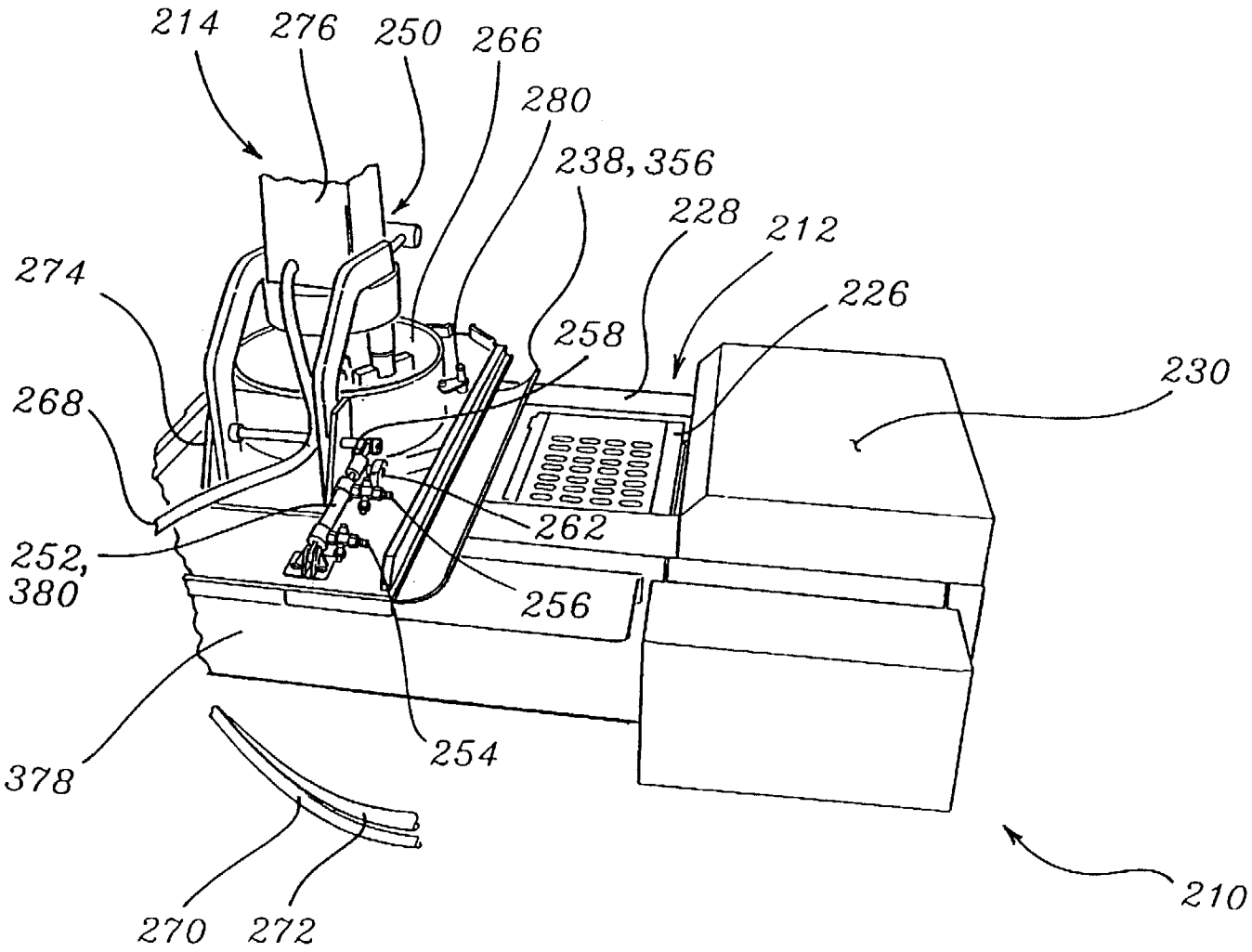
FIG. 26 is a partial rear elevational view of the card loading and filling stations.

A rear view of this station is illustrated in FIG. 26 and A-VI and also illustrates the jam plate and a power card 268 for providing power to the filler unit 250 and compressed air lines 270 and 272 (not connected to the piston 252 in this view). This preferred embodiment includes a pivot assembly 274 for tilting the motor 276 and raising the arm and bristles assemblies 278 out of the hopper 266.

The hopper 266 is held in place with a latch assembly 280 located adjacent the hopper. These latches are a modification of the latches disclosed in the parent application and are located in an overflow or spill bin 282 with a spout 284 which is added in the preferred embodiment of the present application.

As in the single pill card filling unit the height or gap between the in the unit 250 is adjustable. A hand wheel height adjusting member 286 is provided in lieu of the knob 46 in the previously described unit.

The adjusting member 286 includes a locking mechanism. The locking mechanism in a presently preferred embodiment comprises a spherical handle 288 attached to a biased shaft 290.

The shaft 290 extends through the adjusting member and an end of the shaft is received in one of a plurality of holes 292. The holes are spaced apart in an arc so that movement of the adjusting member 286 is limited to the desired 1/32" increments discussed above.

Operation of the adjusting mechanism in unit 250 is substantially similar to the operation described above for the pill card filling unit. One with ordinary skill in the art will recognize the slight modifications that will allow the conveyor to convey the unfilled pill card through the unit 250 from the fill station 214 to the folding stations 216 upon reading this disclosure.

Figure 27:
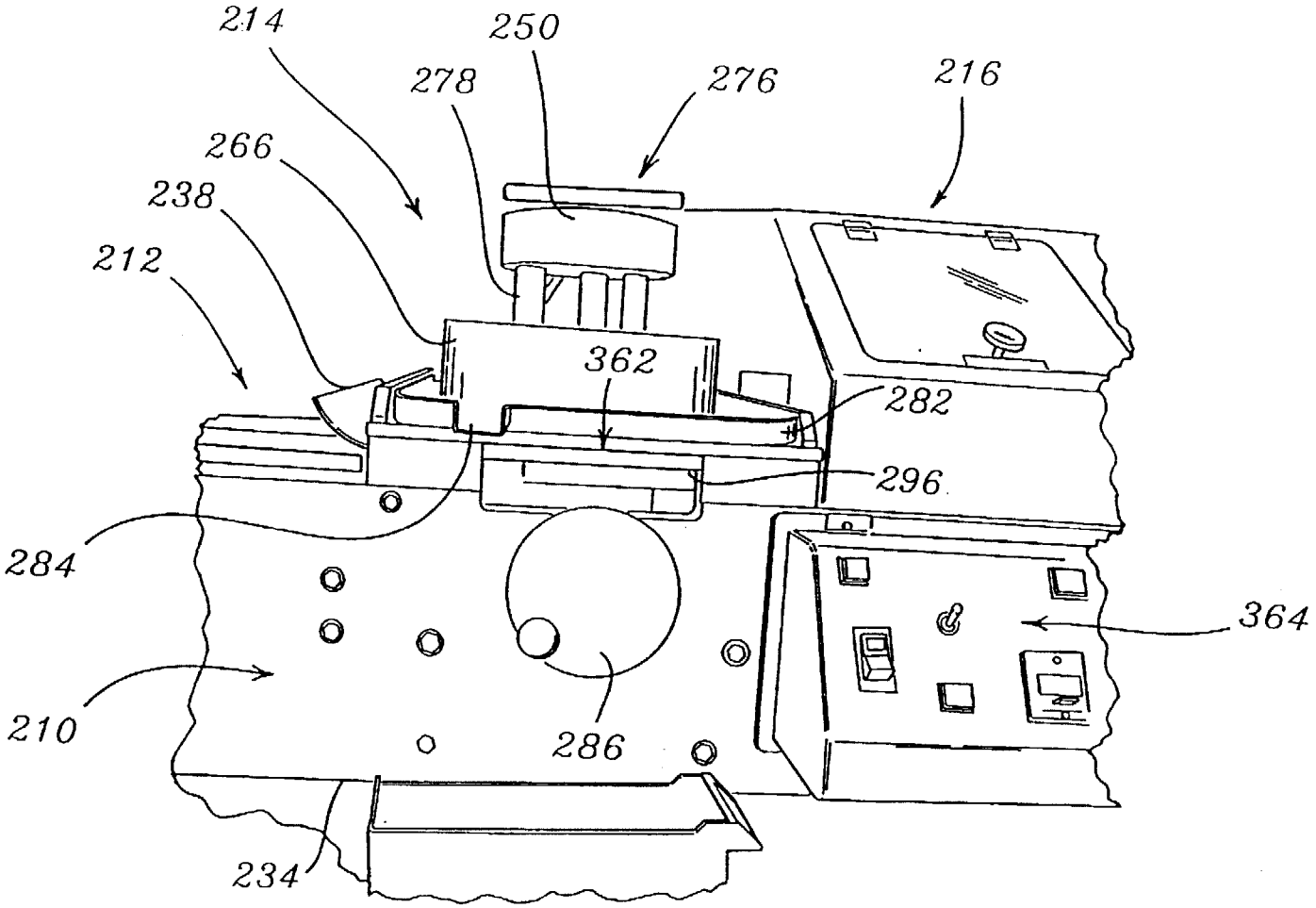
FIG. 27 is a partial front elevational view of the card loading, filling, viewing and inspecting stations.

A front partial elevational view is illustrated in FIG. 27 (A-VII) showing the adjustment mechanism 286. Also illustrated in this drawing figure is a work surface 296 which is raised and lowered by the adjustment mechanism 286 previously described.

The work surface 296 is illustrated in one of its extreme positions. Operation and adjustment of the work surface will be understood from the preceding description of the single filler unit as well as any additional mechanical modifications (not shown) to integrate the filler unit into apparatus 210.

The speed of the motor 276 can be adjustable as previously discussed. A speed control 294 is shown on the front of the motor housing.

Figure 28:
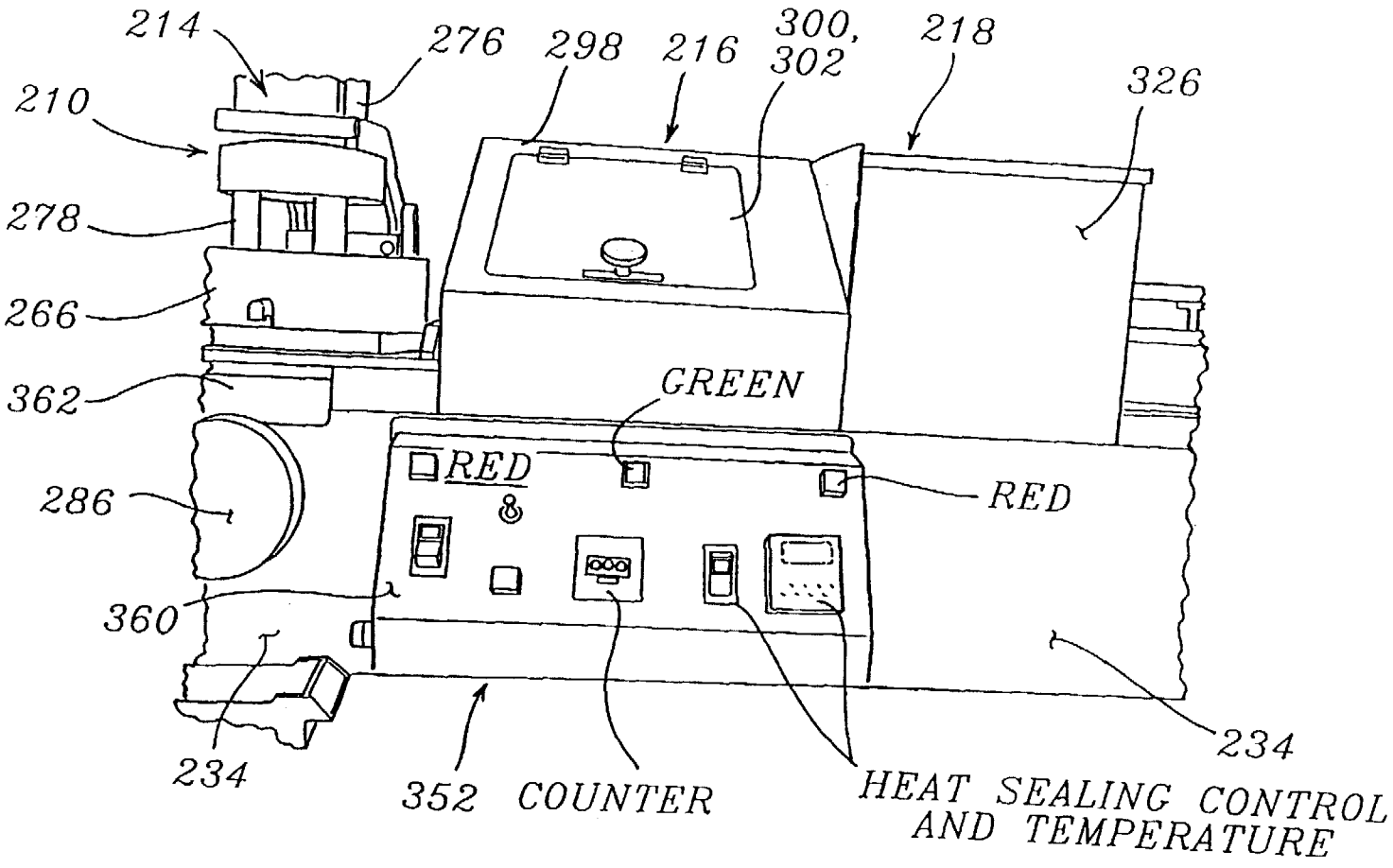
FIG. 28 is a partial front elevational view of the card inspecting and folding station, heat sealing station and a control panel.

FIG. 28 (A-VIII) illustrates a partial elevational view of apparatus 210 and more particularly folding station 216. The folding station is enclosed in a protective enclosure 298 having a viewing window 300 and access door 302.

Figure 29:
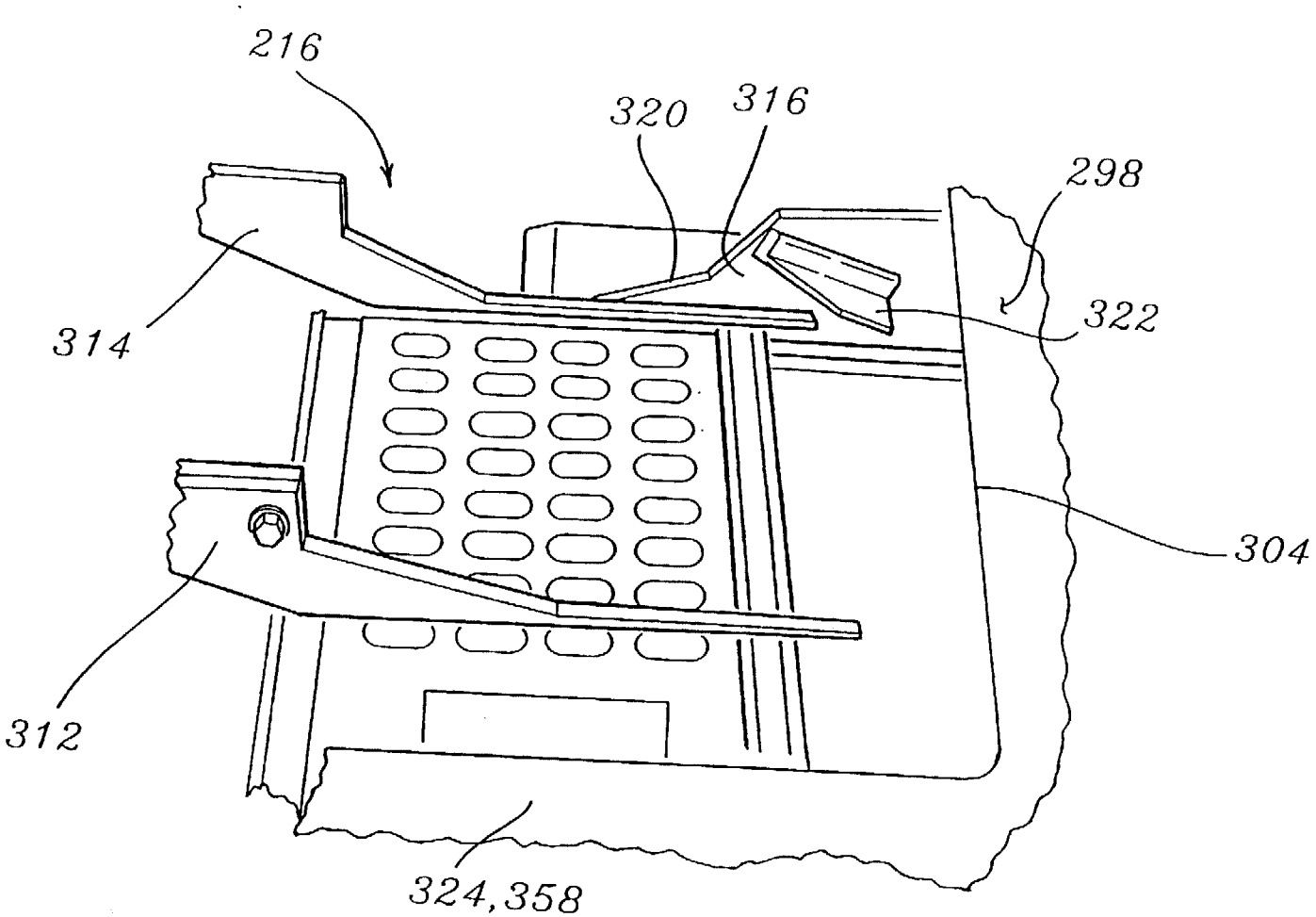
FIG. 29 is a close-up view of the inspection and folding station without a pill card present.

FIG. 29 (A-IX) shows an partial elevational view of the folding station 216 and housing 298 in which the access door 302 has been raised to expose the interior of the folding station through access opening 304. An empty paddle 228 is shown relative to the folding mechanism used to fold over the unfolded blister card cover prior to entry into the heat sealing apparatus at station 218.

Figure 30:
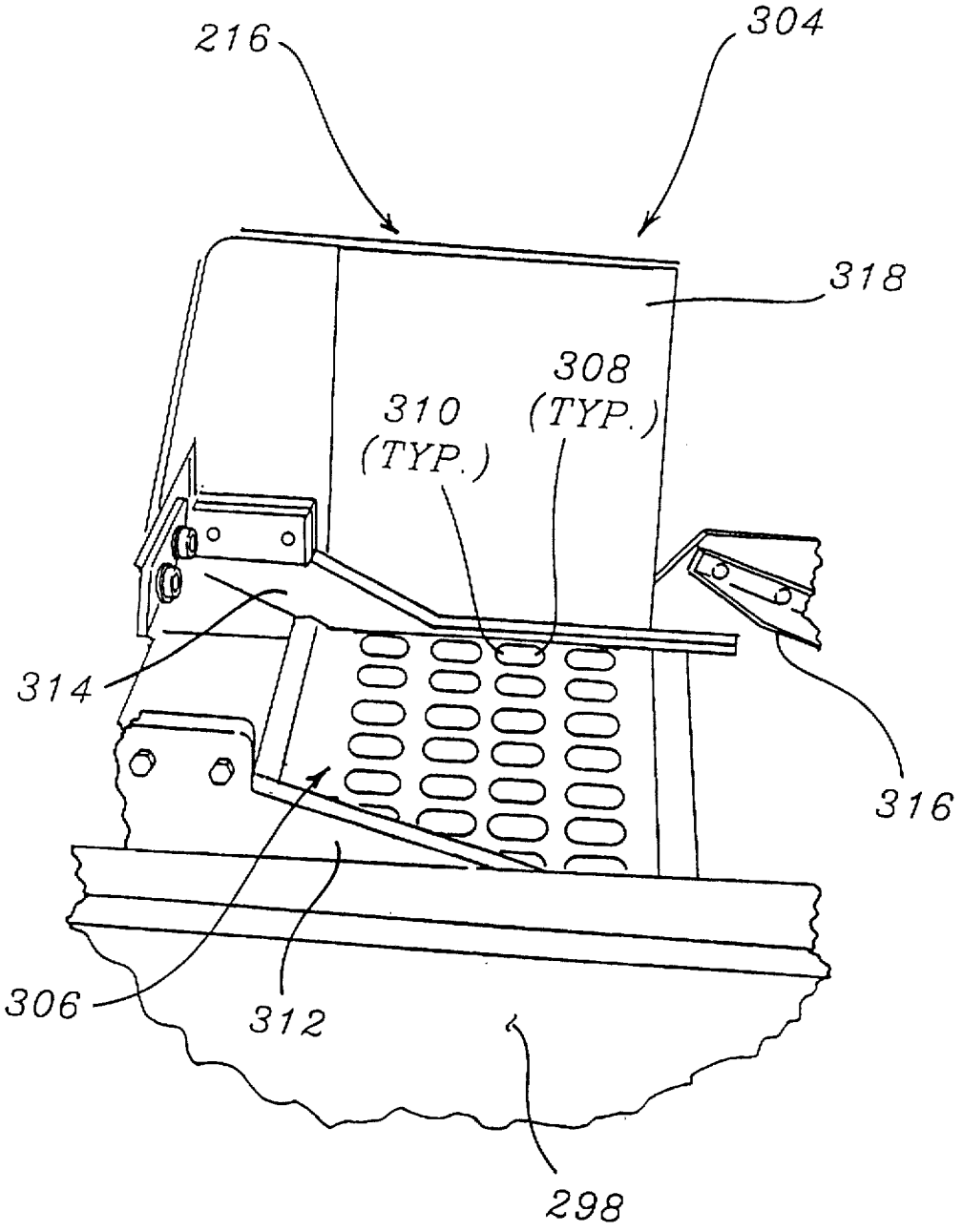
FIG. 30 is a close-up view similar to FIG. 29 with a pill card present.

A filled but unsealed blister card 306 at the folding station 216 is illustrated in FIG. 30 (A-X). A typical capsule 308 is shown in each of the desired blister card receptacles 310.

These two drawing figures illustrate the manner in which arms 312 and 314 restrain the receptacle portion of the pill card 306 when the conveyor stops at the folding station 216. Another arm 316 points in the direction from which the blister card has been moved and extends under the cover 318 so as to raise the cover in a substantially upright position prior to the conveyor moving each modified paddle to its next station.

The arm 316 (partially hidden in FIG. 30) has an angled portion 320 that forces the cover into its upright position. It will be understood from the drawings that oppositely angled member 322 located at least partially behind the upright cover will force the cover over and on the top of the now filled pill card 306.

A switch 324 is located relative to the access door 300 and is connected to the conveyor power source. The power source is stopped and an air brake (not shown) stops the conveyor 224 as is done when the jam plate 238 is lifted.

Figure 31:
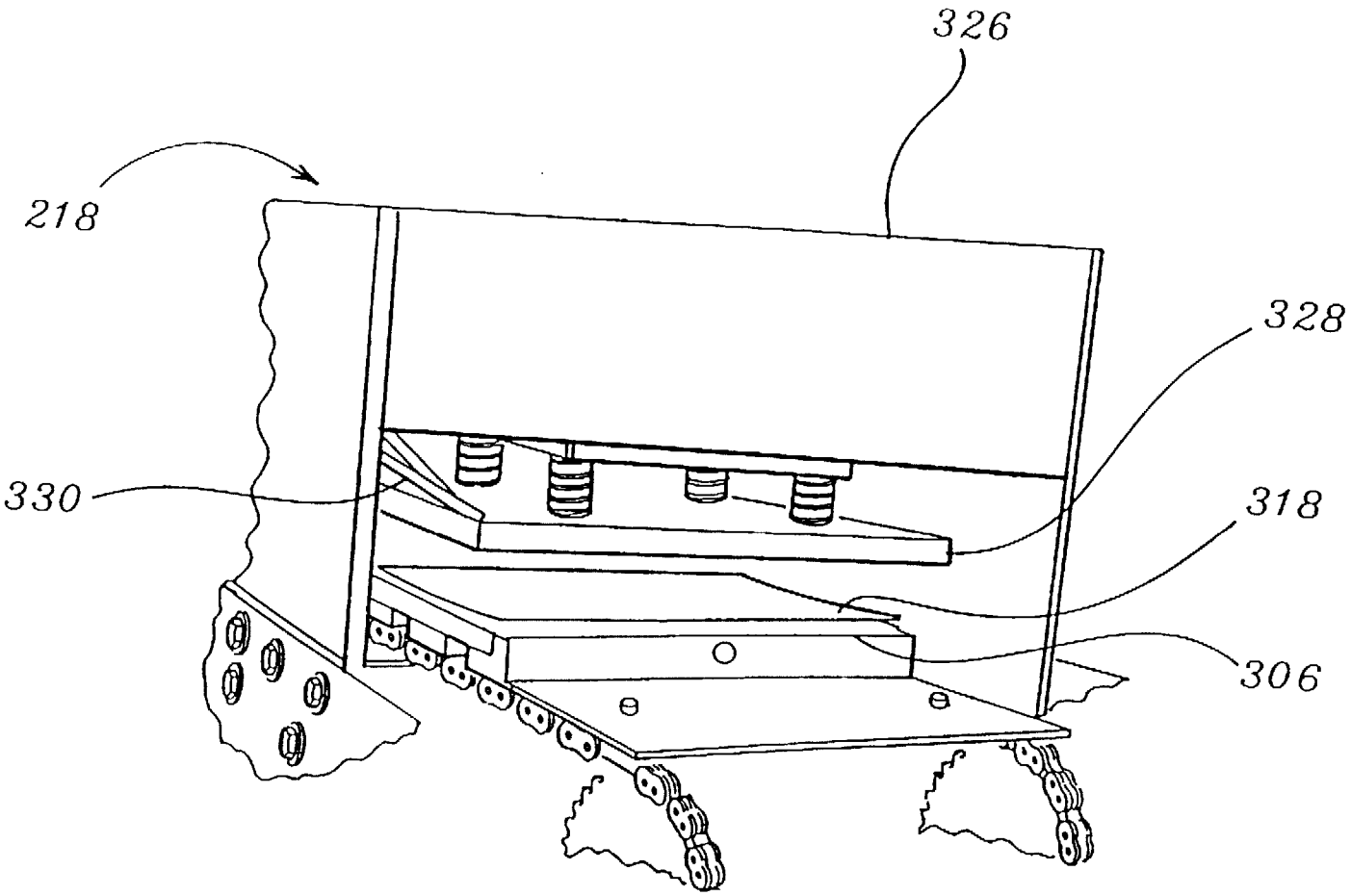
FIG. 31 is an elevational view of the heat sealing station with a folded pill card present.

The sealing station 218 comprises a conventional heat sealing device 326. The interior of the heat sealing device is illustrated in FIG. 31 (A-XI) with an electrically heated plate 328.

The plate is heated by electricity supplied by wires 330. The plate 328 is moved vertically in a conventional manner so as to heat and press the cover 318 (now folded over) onto the pill receiving portion of card 306 once it is moved to the sealing station to heat seal the pill card in a conventional manner.

A portion of the heat sealing device has been removed to better illustrate the conventional internal arrangement of the components. The unconventional portion of the arrangement of this station is the use of the conveyor to move the filled pill card to and from the heat sealing station to the last station in the presently preferred embodiment prior to discharge of the pill cards.

It should be understood at this juncture that the apparatus could discharge the filled and sealed pill card after heat sealing (including the required residence time). In the presently preferred embodiment of this invention a final station, the printing station 220 is intermediate the heat sealing station and the discharge or card unloading station 222.

Figure 32:
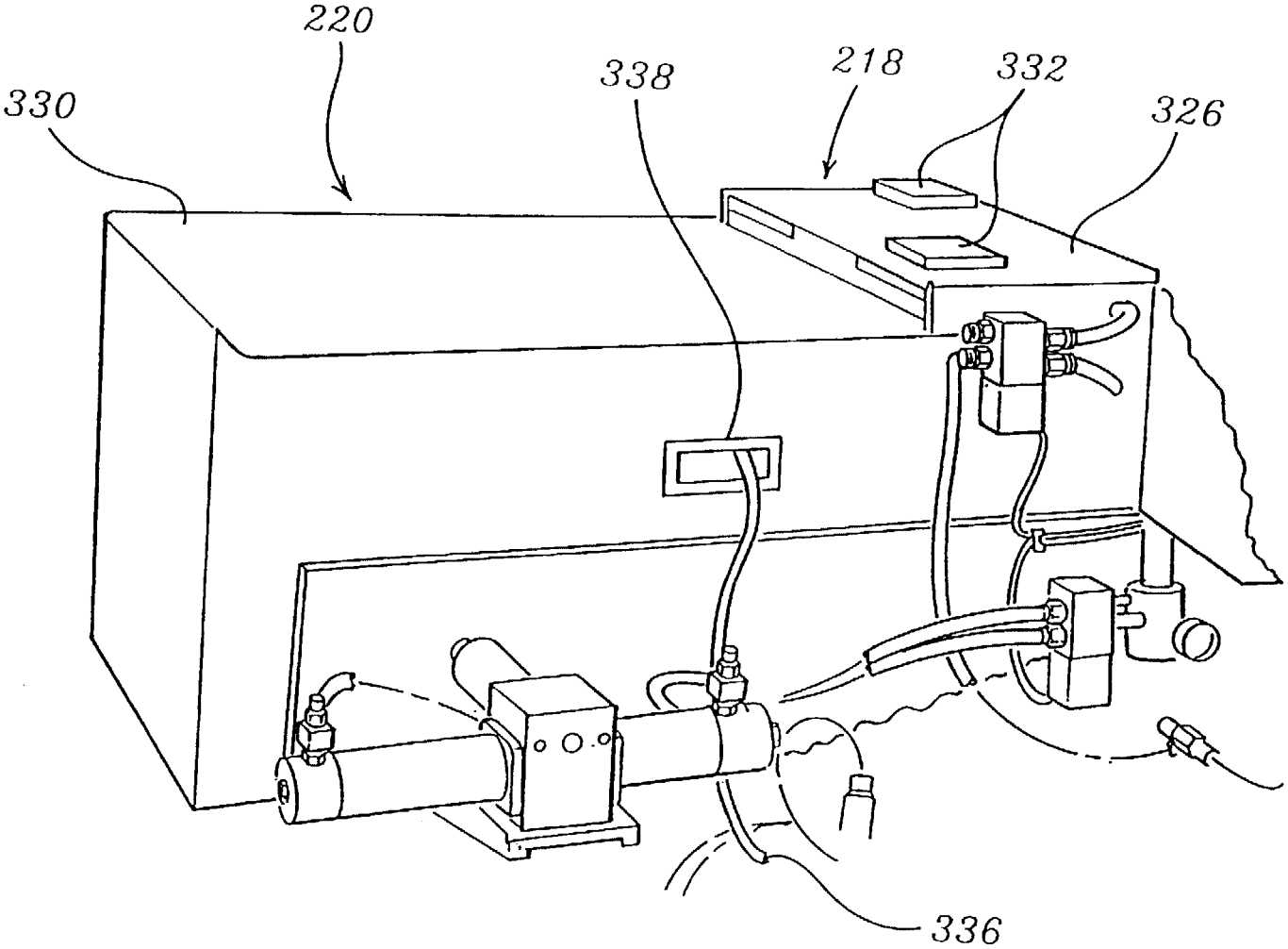
FIG. 32 is a rear elevational view of the heat sealing, printing and unloading station.

The printing station 220 and unloading station 222 of the presently preferred embodiment is illustrated in FIGS. 32 through 35 (A-XII–A-XV). FIG. 32 illustrates a partial rear elevational perspective showing a protective enclosure 330 placed over these final stations.

Vents 332 in housing 326 are also depicted. These vents allow excess heat to escape from the sealing unit at station 218.

A printer 334 is located within housing 330. Printer data is supplied by a data connection 336 that connects the printer through an opening 338 in enclosure 330 with a central processing unit (not shown).

Figure 33:
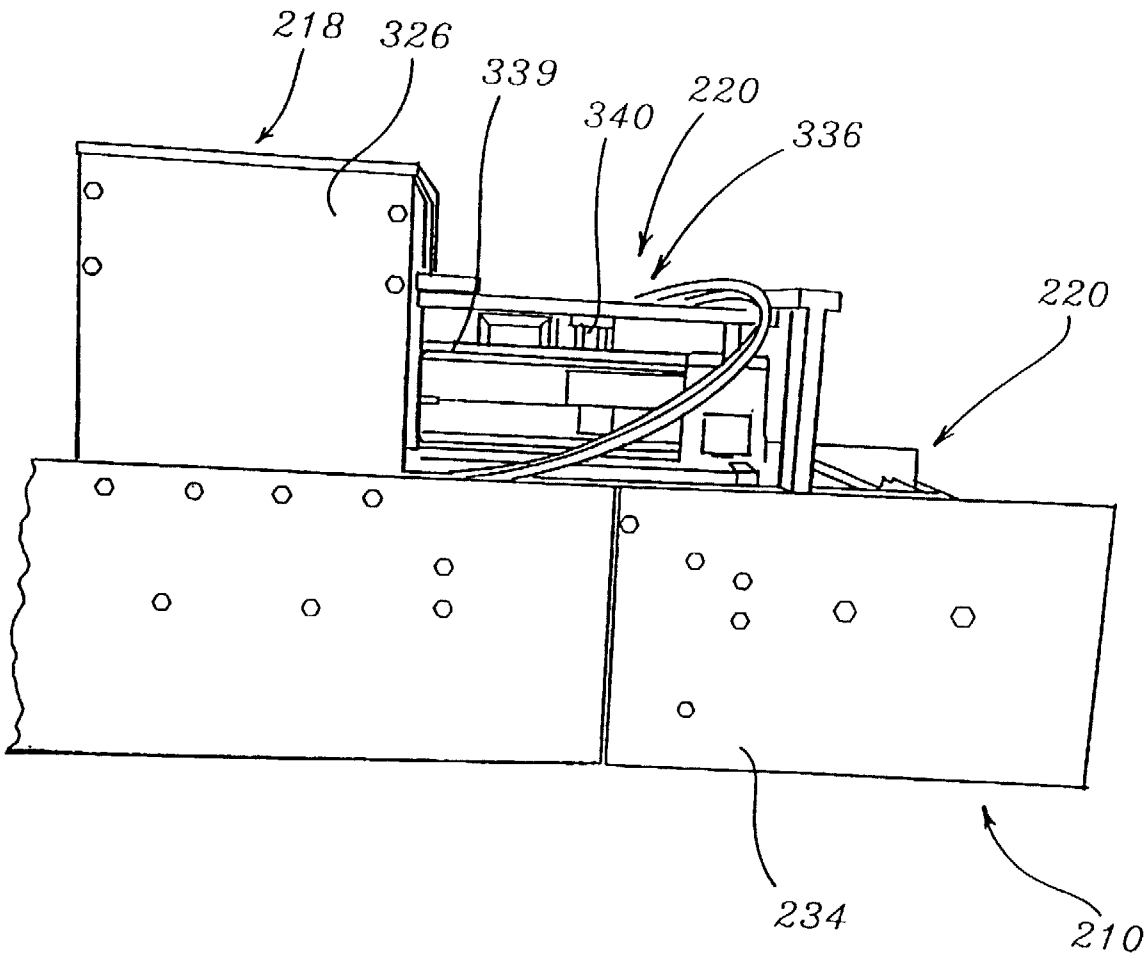
FIG. 33 is a front elevational view of the heat sealing, printing and unloading station.

A front partial elevational view is provided in FIG. 33 (A-XIII) illustrating the printing station 220 and the unloading station 220 without housing 330. It will be understood from other drawing figures and the photographs in the Appendix that a printer 336 is suspended over the now sealed pill card 306.

In order to print on the filled and sealed pill card the printer is moved from an upper standby position to a lower printer position. This is accomplished in the presently preferred embodiment by mounting the printer on a vertically moveable frame structure 339 that is operated by a compressed air driven piston 340 fed by compressed air lines 342.

Figure 34:
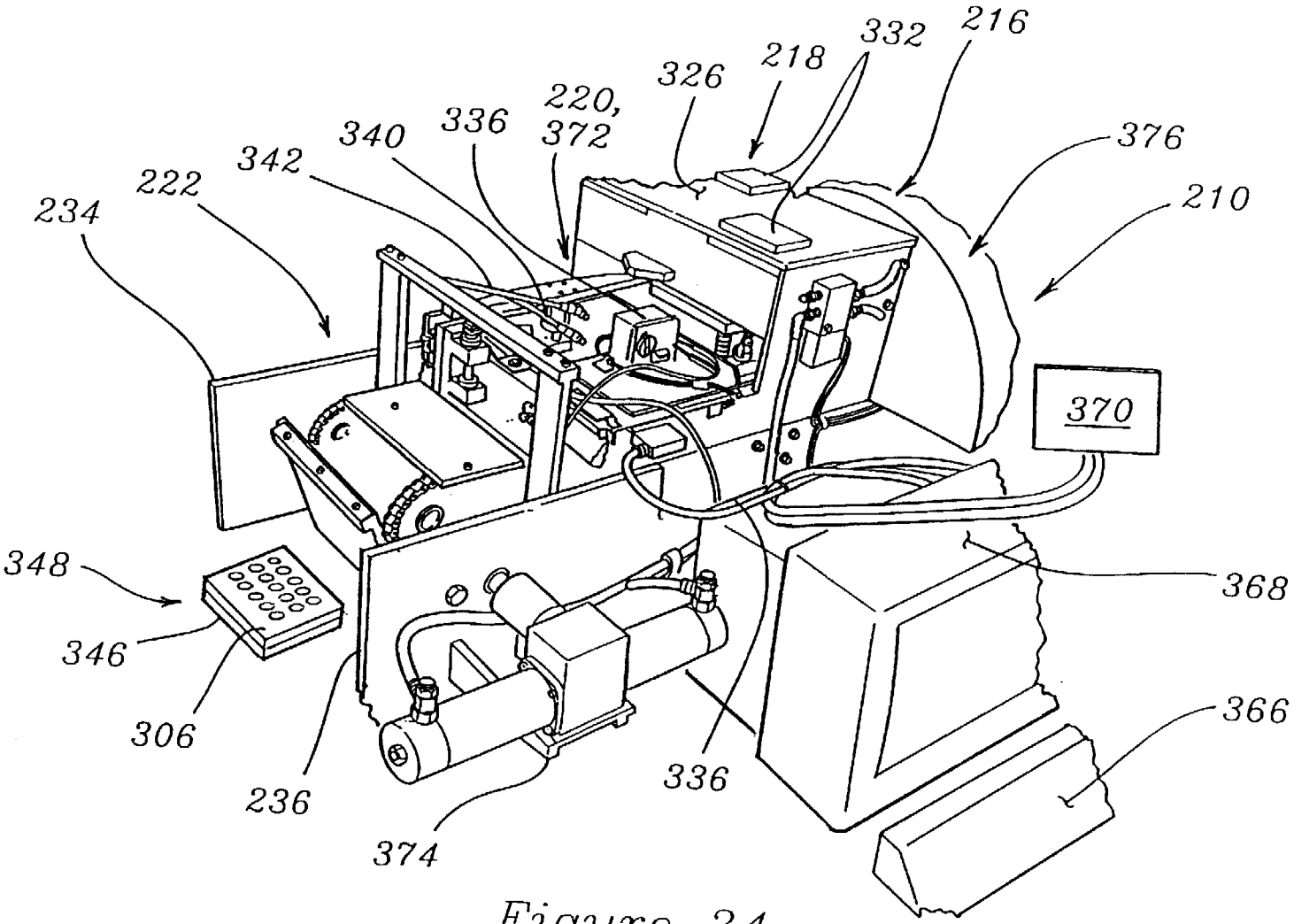
FIG. 34 is a rear elevational view of the heat sealing, printing and unloading station.
Figure 35:
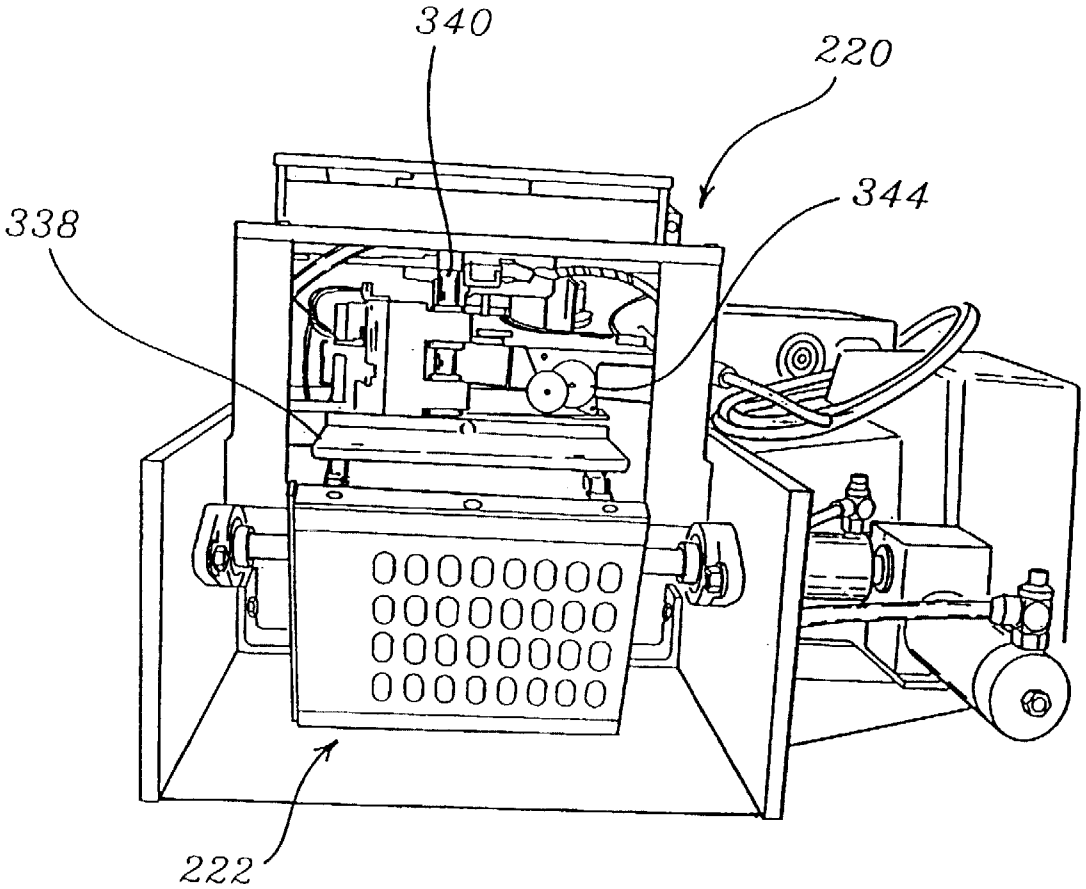
FIG. 35 is an end view of the printing and unloading station.

This arrangement can be seen from a rear elevational view and an end elevational view of the apparatus 210 in FIGS. 34 and 35 (A-XIV, A-XV). These views also depict one preferred embodiment for suspending a printer carriage 344 that moves relative to a stationary filled and sealed pill card in order to print the desired indicia on the card while the moveable frame structure 338 moves vertically.

A stack 346 of filled, folded, sealed and printed pill cards 306 builds up as the conveyor makes a downward turn to return the now empty modified paddle to the first station 212 of apparatus 210. This occurs for each modified paddle in turn at receiving hopper 348.

In operation, in connection with the automated pill card filling, sealing and printing (if desired) apparatus 210 to automatically fill a pill card, fold the top and seal the top, heat seal and print an indicia (if desired), an empty pill card is loaded into a modified paddle carried by the conveyor at Station 1 (212). The card is filled with pills or capsules at Station 2 (214).

The now filled card is inspected at Station 3 (216) through the access door window. If a problem is observed, then the door can be opened (which stops the conveyor) and the problem fixed, if possible before shutting the access door and restarting the apparatus.

The card is heat sealed at Station 4 (218) and a label printed directly onto the card at Station 5 (220). Finally, the filled, folded, sealed and labelled card is ejected into a hopper or other receiving area at Station 6 (222).

Figure 36:
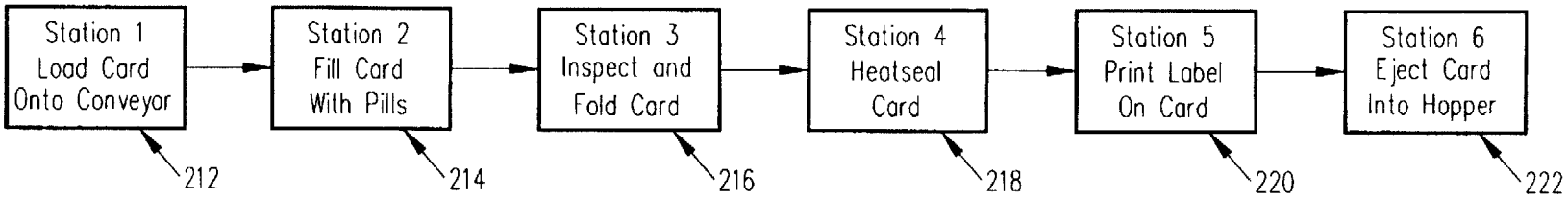
FIG. 36 is an operation flow chart for the present invention.
Figure 37:
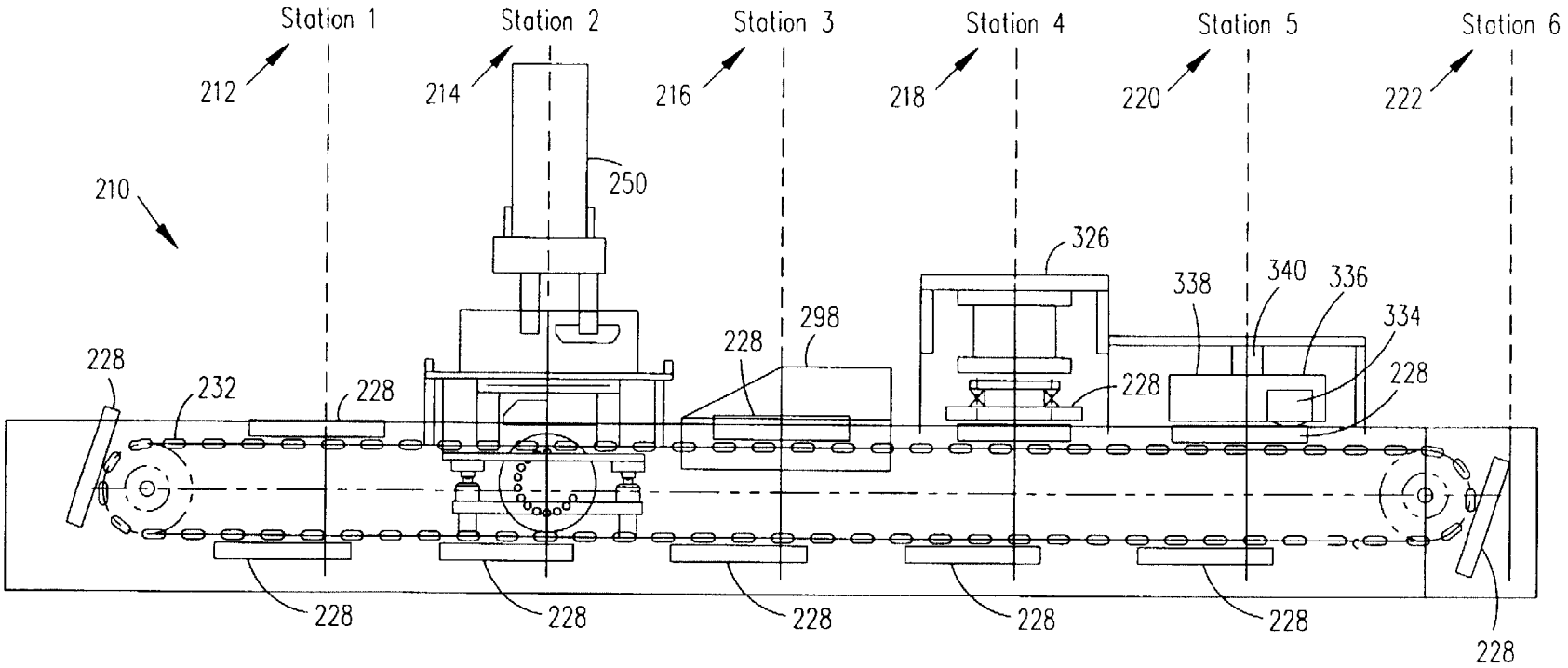
FIG. 37 is a general section view of the apparatus of the present invention illustrating the conveyor path relative to the various stations.

FIGS. 36 and 37 depict the steps of the present invention and general conveyor layout. It now will be understood how the conveyor can have a modified paddle 228 at each Station and corresponding modified paddle 228 on the lower course of the conveyor 232.

It will be seen from these and the previous drawings and Appendix photographs that the modified paddle 228 at Station 6 (222) is preferably stopped when the paddle is tilted past vertical. In this way the completed pill card should fall out of the paddle into the receiving area or hopper.

Figure 38:
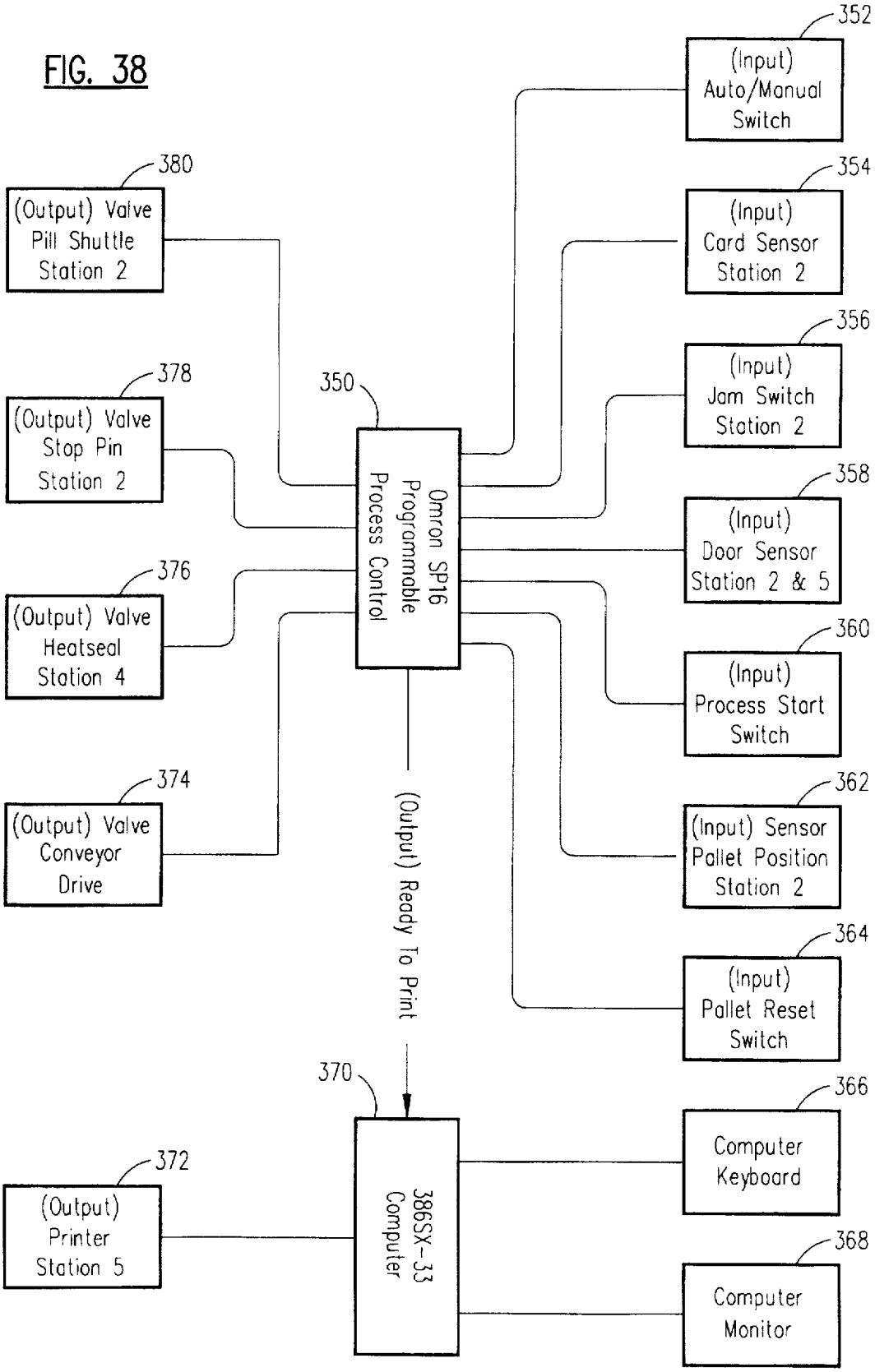
FIG. 38 is a control logic diagram.
Figure 39:
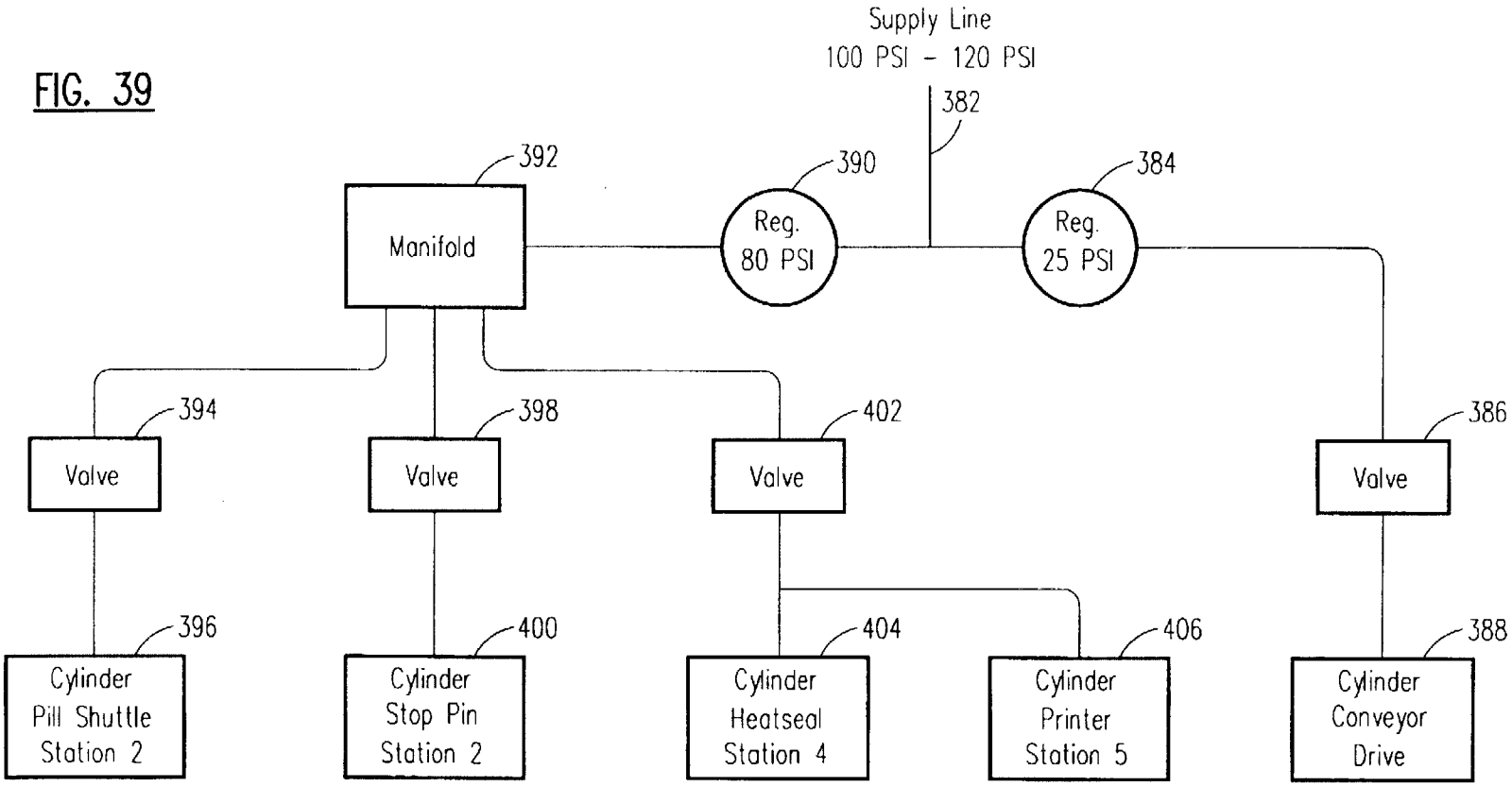
FIG. 39 is a compressed air diagram.

FIGS. 38 and 39 provide a control logic diagram and a compressed air diagram, respectively, for the presently preferred embodiment of the present invention. Reference characters on these two (2) drawings have been cross-referenced the drawing figures or to the photographs A-I through A-XX, whichever is believed to provide greater clarity.

The present invention has two (2) control systems. One controls the operation of the conveyor, pill card filling unit and the heat seal unit, while the other system is used to input information and then print the information on the pill card.

A preferred embodiment of the first control system comprises an Omron brand SP16 Programmable Logic Controller with a "Ladder Logic" software language supplied by Omron. The software program generated for the described embodiment of the present invention is designated as "0772" by the applicants.

The second of the two control systems is established using a 386SX-33 computer running DOS 6.2 and the application software was generated using Microsoft Basic. The software program generated for the described embodiment of the present invention is designated as "AUTOPLUS CONTROL PROGRAM" by the applicants.

An auto/manual switch 352 is provided to allow selection of the operation of the apparatus or for trouble shooting when the conveyor is to be advanced in a manually controlled manner. The card input station 354 senses whether a card has been loaded into its intended modified paddle.

The jam switch 356 for Station 2 and the door sensors 358 for Stations 2 and 5 shut the conveyor down if a door opens during operation. The palet (or paddle) position switch 362 centers the paddle and its empty pill card directly below fill unit 250.

The start switch 360 is self-explanatory. Ideally, this switch is located on the control panel on the front of the apparatus 210.

Palet reset switch 364 simply resets the system. Once reset, the system resumes operation.

The pill shuttle valve 380 operates the shuttle so as to cause the pills or capsules to drop into the previously empty pill card. The stop pin valve 378 is the "brake" for stopping the conveyor when a jam or a door is open, for example.

The conveyor drive output valve 374 allows power (e.g., compressed air) to be fed to the compressed air motor. This motor drives the conveyor in the preferred embodiment disclosed herein.

The valve 376 at the heat seal station operates the heated member. This is the member that raises and lowers and seals the cover on the pill card.

In FIG. 39 the labels will be self-explanatory to one skilled in the art. The reference characters 382 through 406 have also been applied to the drawings figures for the apparatus 210 and possibly the photographs in the Appendix.

It will be understood that other hardware, operating systems and software could be used to effectuate the disclosed or another control logic for the present invention. The same can be said of the compressed air diagram in FIG. 39, that is, variations can be made without leaving the scope of the present invention.

While two (2) specific embodiments have been described, one with a printer and one without the printer, many variations are possible. The particular size and shape of the paddles and pill cards can be varied and any dimensions modified to suit.

Having described the invention in detail, those skilled in the art will appreciated that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A machine to fill empty blister packs with solid objects and automatically seal them comprising:

a modified paddle to receive an empty blister pack at a starting point;

means to fill said blister packs, said means including a variable height work surface comprising:

a work surface to support the modified paddle and empty blister pack into which the solid objects are to be dispensed;

an alignment means to maintain the work surface in level vertical alignment with a solid object dispenser;

at least one asymmetric cam located below and supporting the work surface in horizontal position;

an axle to support the cam;

means to support the axle; and means to turn the cam, whereby upon turning the asymmetric cam the distance between the axle and the cam periphery is varied resulting in a corresponding variation of the height of the work surface;

said machine further including means to fold filled blister packs;

means to seal filled blister packs;

means to transport blister packs from said collector to said means to fill said blister packs then to said means to fold filled blister packs and finally to the means to seal filled blister packs; and means to return modified paddle to the starting point, whereby another blister pack may be automatically filled with solid objects and sealed shut.

2. A machine as defined in claim 1 further including means to lock the cam in a selected position.

3. A machine as defined in claim 1 wherein the alignment means includes telescoping members.

4. A machine as defined in claim 1 wherein the asymmetric cam has a radius which varies by at least one quarter inch.

5. A machine as defined in claim 1 wherein the means to support the axle is at least one bearing member.

6. A machine as defined in claim 1 wherein the means to turn the cam includes the combination of the axle and a handwheel suitable for turning the axle and the associated cam.

7. A machine as set forth in claim 1 wherein the cam has a radius which varies by at least one quarter inch;

the means to support the axle includes a pillow block to support the axle, a portion of the pillow block being adjacent to a face portion of the cam; and wherein the means to fill said blister packs further includes means to lock the cam in position, whereby upon turning the asymmetric cam the distance between the axle and the cam periphery is varied resulting in a corresponding variation of the height of the work surface.

8. A machine as defined in claim 7 wherein the cam further includes radial portions corresponding to nine positions varying 1/32" from each other, so that the work surface height can be varied in 1/32" increments.

9. A machine as defined in claim 7 wherein the means to turn the cam includes the axle extending beyond the work surface of the apparatus and a handwheel on the end of the axle.

10. A machine as defined in claim 7 wherein the means to lock the cam in position is an indexing device comprising a combination spherical handle and biased shaft passing through the handwheel and into engagement with the apparatus, whereby the handwheel is held in the desired position.

11. A machine as defined in claim 7 wherein the pillow block further includes a portion which directly supports the cam.

12. A machine as set forth in claim 1 wherein the modified paddle includes a modified blister pack paddle support frame.

13. A machine as set forth in claim 12 further comprising an endless conveyor for supporting and transporting a modified blister pack paddle in its blister pack paddle support frame between at least two stations of the machine.

14. A machine as set forth in claim 13 further comprising a protective housing intermediate the blister pack paddle support frame and endless conveyor at an end of the machine where an empty blister pack is placed in a blister pack paddle conveyed by the blister pack paddle support frame and conveyor.

15. A machine as set forth in claim 13 wherein the blister pack paddle and blister pack paddle support frame are of sufficient size to support the blister pack and associated blister pack cover in an open position while it is conveyed to the means to fold filled blister packs.

16. A machine as set forth in claim 1 wherein the means to fill said blister packs further includes means for operating a shuttle.

17. A machine as set forth in claim 16 wherein the means for operating the shuttle is powered by an external power system.

18. A machine as set forth in claim 17 wherein the means for operating the shuttle is the same power system utilized to operate the means to transport the blister packs.

19. A machine to fill empty blister packs with solid objects and automatically seal them comprising:

a modified paddle to receive an empty blister pack at a starting point;

means to fill said blister packs, the means to fill said blister packs including a variable height work surface comprising:

a work surface to support the modified paddle and empty blister pack into which the solid objects are to be dispensed and the empty blister pack filled;

an alignment means to maintain the work surface in level vertical alignment with the dispenser;

at least one asymmetric cam located below and supporting the work surface in horizontal position, the cam having a radius which varies by at least one quarter inch, the cam further including radial portions corresponding to nine discreet positions varying 1/32" from each other, so that the work surface height can be varied in 1/32" increments;

an axle to support the cam;

a pillow block to support the axle, the pillow block further including a portion which supports the cam directly;

means to turn the cam to present varying cam radius lengths to the work surface including the axle extending beyond the work surface of the apparatus and a knob on the end of the axle;

means to lock the cam in position, whereby upon turning the asymmetric cam the distance between the axle and the cam periphery is varied resulting in a corresponding variation of the height of the work surface;

said machine further including means to seal filled blister packs;

means to transport blister packs from said collector to said means to fill said blister packs then to said means to fold filled blister packs and finally to the means to seal filled blister packs; and means to return modified paddle to the starting point, whereby another blister pack may be automatically filled with solid objects and sealed shut.

20. An automated apparatus for filling blister packs with solid objects, the apparatus comprising:

a loading station;

a card filling station including means to fill said blister packs, said means including a variable height work surface comprising:

a work surface to support the modified paddle and empty blister pack into which the solid objects are to be dispensed;

an alignment means to maintain the work surface in level vertical alignment with a solid object dispenser;

at least one asymmetric cam located below and supporting the work surface in horizontal position;

an axle to support the cam;

means to support the axle; and means to turn the cam, whereby upon turning the asymmetric cam the distance between the axle and the cam periphery is varied resulting in a corresponding variation of the height of the work surface, the apparatus further comprising:

a card folding station;

a card sealing station;

a card unloading station; and means for conveying at least one blister pack from one station to another station.

21. An automated apparatus as set forth in claim 20 further including a card printing station.

22. An automated apparatus as set forth in claim 20 wherein the means for conveying includes a chain and sprocket assembly.

23. An automated apparatus as set forth in claim 22 further comprising means for adjusting means for conveying tension, whereby blister pack alignment within the automated apparatus may be maintained.

24. An automated apparatus as set forth in claim 22 further comprising means to stop the automated apparatus.

25. An automated apparatus as set forth in claim 24 wherein the means to stop the apparatus actuates means for braking the means for conveying.

26. An automated apparatus as set forth in claim 25 wherein the means for braking is an air operated brake.

27. An automated apparatus as set forth in claim 24 wherein the means to stop the automated apparatus includes a jam plate intermediate the loading station and the card filling station, whereby actuation of the jam plate by a card that does not remain flat stops the means for conveying.

28. An automated apparatus as set forth in claim 27 wherein the jam plate is a curved plate on a pivot that is moved by a non-flat card, whereby means for braking is activated by movement of the curved plate about the pivot.

29. An automated apparatus as set forth in claim 20 wherein the card folding station includes one arm member to hold a now filled but still open blister card in place and another arm member located to extend under an unfolded cover and an oppositely angled member to fold the cover over the filled blister card as the means for conveying moves the blister pack to the next station.

30. An automated apparatus as set forth in claim 20 wherein the folding station includes an enclosure and an access door.

31. An automated apparatus as set forth in claim 30 wherein the access door is in operative association with a switch that operates a means for stopping the apparatus when the access door is opened.

32. An automated apparatus as set forth in claim 30 wherein the access door further includes a viewing portion whereby the operation of the apparatus can be visually inspected at the folding station.

33. An automated apparatus as set forth in claim 20 further including a printing station and a data link between the printing station and a central processing unit, whereby the indicia to be printed on a cover of a sealed pill card is transmitted to the printer from the central processing unit.

34. An automated apparatus for filling blister packs with solid objects, the apparatus comprising:

a loading station;

a card filling station;

a card folding station;

a card sealing station;

a card unloading station;

means for conveying at least one blister pack from one station to another station; and a printing station wherein a printer has a first standby position and a second printing position.

35. An automated apparatus as set forth in claim 34 further wherein the printer is mounted on a vertically moveable frame structure.

36. An automated apparatus as set forth in claim 35 wherein the frame structure is operated by a piston.

37. An automated apparatus as set forth in claim 36 wherein the piston is operated by compressed air.

38. A method of filling empty blister packs with solid objects and automatically sealing them, the method comprising:

providing a modified paddle to receive an empty blister pack at a starting point;

filling said blister packs with a means to fill said blister packs, the step of filling said blister packs including;

supporting the modified paddle and empty blister pack into which the solid objects are to be dispensed with a work surface;

aligning the work surface in level vertical alignment with a solid object dispenser;

supporting the work surface in a horizontal position with at least one asymmetric cam located below the work surface;

supporting the cam with an axle;

supporting the axle;

turning the cam; and varying the height of the work surface by turning the asymmetric cam;

the method of filling further comprising folding said blister packs with a means to fold filled blister packs;

sealing said blister packs with a means to seal filled blister packs;

transporting said blister packs with a means to transport blister packs from said collector to said means to fill said blister packs then to said means to fold filled blister packs and finally to the means to seal filled blister packs; and returning said modified paddle to the starting point, whereby another blister pack may be automatically filled with solid objects and subsequently sealed shut.

39. A method of filling empty blister packs with solid objects as set forth in claim 38 further including the step of locking the cam in a selected position.

40. A method of filling empty blister packs with solid objects as set forth in claim 38 further including the step of aligning the work surface by telescopically moving telescoping members supporting the work surface.

41. A method of filling empty blister packs with solid objects as set forth in claim 38 further including the step supporting and transporting a modified blister pack paddle in its blister pack paddle support frame between at least two stations of the machine.

42. A method of filling empty blister packs with solid objects as set forth in claim 41 further including the step of supporting and transporting the blister pack with the associated blister pack cover in an open position until it is folded over by the means to fold filled blister packs.

43. A method of automatically filling blister packs such as pill cards with solid objects, the method comprising the steps of:

loading an empty pill card at a loading station;

filling the pill card with solid objects at a card filling station, the step of filling said pill cards including:

supporting the modified paddle and empty blister pack into which the solid objects are to be dispensed with a work surface;

aligning the work surface in level vertical alignment with a solid object dispenser;

supporting the work surface in a horizontal position with at least one asymmetric cam located below the work surface;

supporting the cam with an axle;

supporting the axle;

turning the cam; and varying the height of the work surface by turning the asymmetric cam;

the method of filling further comprising:

folding the pill card at a pill card folding station in preparation of heat sealing the pill card;

sealing the folded pill card at a card sealing station;

removing the filled and sealed pill card at a card unloading station; and conveying the pill card by a means for conveying at least one blister pack from one station to another station.

44. A method as set forth in claim 43 further including the step of printing indicia related to the solid objects in the sealed pill at a card printing station.

45. A method as set forth in claim 43 further including the step of adjusting the means for conveying in order to maintain desired blister pack alignment within the automated apparatus.

46. A method as set forth in claim 43 further including the step of stopping the apparatus upon the occurrence of a selected event during the pill card's movement through the automated apparatus.

47. A method as set forth in claim 46 further including the step of actuating the stopping of the means for conveying by moving a jam plate intermediate the loading station and the card filling station with a pill card that does not remain flat, thereby stopping the means for conveying.

48. A method as set forth in claim 43 further including the step of stopping the apparatus by stopping the means for conveying with a means for braking the means for conveying.

49. A method as set forth in claim 43 further including the steps of:

holding a now filled but still open blister card with one arm member;

extending another arm member under an as of yet unfolded cover of the now filled blister card as the means for conveying transports the pill card through the folding station; and folding the cover over the top of the pill card with the other arm member and an oppositely angled member as the means for conveying moves the blister pack to the next station.

50. A method as set forth in claim 43 further including the step of operating a means for stopping the apparatus by opening an access door proximate the folding station.

51. A method as set forth in claim 43 further including the step of visually inspecting the pill card at the folding station through a viewing portion whereby the operation of the apparatus can be visually inspected at the folding station.

52. A method as set forth in claim 43 further including the step of transmitting data to be printed on as indicia on the pill card to a printing station over a data link between the printing station and a central processing unit, whereby the indicia to be printed on a cover of a sealed pill card is transmitted to the printer from the central processing unit.

53. A method of automatically filling blister packs such as pill cards with solid objects, the method comprising the steps of:

loading an empty pill card at a loading station;

filling the pill card with solid objects at a card filling station;

folding the pill card at a pill card folding station in preparation of heat sealing the pill card;

sealing the folded pill card at a card sealing station;

removing the filled and sealed pill card at a card unloading station;

conveying the pill card by a means for conveying at least one blister pack from one station to another station;

maintaining a printer in a standby position at a printing station;

moving the printer to a printing position at the printing station;

printing indicia on the pill card at the printing station; and returning the printer to the standby position.

54. A method as set forth in claim 53 further including the step of mounting the printer on a moveable frame structure at the printing station.

55. A method as set forth in claim 54 further including the step of moving the frame structure with a piston.

56. A method as set forth in claim 55 further including the step of operating the piston with compressed air.

* * * * *